US007311305B2

(12) United States Patent
Matsuno et al.

(10) Patent No.: US 7,311,305 B2
(45) Date of Patent: Dec. 25, 2007

(54) ROULETTE DEVICE AND GAME CONTROL METHOD

(75) Inventors: Masaki Matsuno, Tokyo (JP); Tetsuya Yokota, Tokyo (JP); Yoshitomo Sasaki, Tokyo (JP)

(73) Assignee: Aruze Corp., Tokyo (JP)

( * ) Notice: Subject to any disclaimer, the term of this patent is extended or adjusted under 35 U.S.C. 154(b) by 336 days.

(21) Appl. No.: 11/178,614

(22) Filed: Jul. 12, 2005

(65) Prior Publication Data

US 2006/0170154 A1 Aug. 3, 2006

(30) Foreign Application Priority Data

| | | |
|---|---|---|
| Jul. 13, 2004 | (JP) | P2004-206283 |
| Jul. 13, 2004 | (JP) | P2004-206284 |
| Jul. 13, 2004 | (JP) | P2004-206285 |
| Apr. 7, 2005 | (JP) | P2005-111273 |
| Apr. 7, 2005 | (JP) | P2005-111286 |
| Apr. 7, 2005 | (JP) | P2005-111315 |

(51) Int. Cl.
*A63F 5/02* (2006.01)

(52) U.S. Cl. ..... 273/142 E; 273/142 R; 273/142 B; 273/274; 273/138.2; 273/138.1; 463/17; 463/22

(58) Field of Classification Search ..... 273/142 E, 273/142 R, 142 B, 142 G, 142 H, 142 HA, 273/142 J, 142 JA–142 JD, 274, 138.2, 138.1; 463/17, 22
See application file for complete search history.

(56) References Cited

U.S. PATENT DOCUMENTS 4,337,945 A * 7/1982 Levy ..... 273/142 E
4,869,505 A * 9/1989 Manabe ..... 463/22
6,047,965 A * 4/2000 Mollo et al. ..... 273/142 E

FOREIGN PATENT DOCUMENTS

| | | |
|---|---|---|
| DE | 199 39 656 A 1 | 2/2001 |
| GB | 2 385 541 A | 8/2003 |
| JP | 8-229191 | 9/1996 |
| JP | 09-276477 | 10/1997 |
| JP | 2003-334275 | 11/2003 |
| SU | 1061166 A | 12/1983 |
| WO | WO 99/11341 | 3/1999 |
| WO | WO 01/32278 A1 | 5/2001 |
| WO | WO 03/051476 A1 | 6/2003 |
| WO | WO 2004/011112 A1 | 2/2004 |
| WO | WO 2004/094013 A1 | 11/2004 |

* cited by examiner

*Primary Examiner*—Benjamin Layno
(74) *Attorney, Agent, or Firm*—McGinn IP Law Group, PLLC

(57) ABSTRACT

A roulette device including: a roulette plate having a plurality of marks arranged thereon; a ball which rolls on the roulette plate; a plurality of ball receiving parts which are formed corresponding to the marks in a circumferential direction of the roulette plate to receive the ball; a bank passage which is provided on an outer periphery of the ball receiving parts of the roulette plate and on which the ball rolls along a circumferential orbit; a compressor which compresses air; and a first discharge hole which is provided in each ball receiving part and through which the air compressed by the compressor is discharged to the bank passage.

10 Claims, 30 Drawing Sheets

ROULETTE DEVICE AND GAME CONTROL METHOD

CROSS-REFERENCE TO THE RELATED APPLICATION(S)

This application is based upon and claims a priority from prior Japanese Patent Applications No. 2004-206283, 2004-206284 and 2004-206285 filed on Jul. 13, 2004, and No. 2005-111273, 2005-111286 and 2005-111315 filed on Apr. 7, 2005, the entire contents of which are incorporated herein by reference.

BACKGROUND OF THE INVENTION

1. Field of the Invention

The present invention relates to a roulette device in which a ball is received in a ball receiving part corresponding to a mark formed on a roulette plate and a game control method, in which the ball can be easily found in the roulette plate for increased entertainment by discharging air compressed by a compressor from the ball receiving part and a bank passage and forming the ball receiving part having a depth shorter than the diameter of the ball in respect to an inclined plane formed between the ball receiving part and the bank passage.

2. Description of the Related Art

A medal game, which uses medals, as a game medium such as a roulette gaming machine is started when a game player purchases or borrows a plurality of medals from a medal providing machine and inserts the medals to a gaming machine. If the game player wins the game, he/she can get the predetermined number of medals. Accordingly, the game player who has acquired a plurality of medals can continue to enjoy the game without the need to purchase or borrow additional medals.

In the roulette gaming machine, when the game player selects a mark (a numeral) provided on the roulette plate, the roulette plate is rotated and a discharged ball rolls on the roulette plate. When the roulette plate is decelerated and the ball is received in any part of the roulette plate, it is determined whether or not the mark (numeral) selected by the player is identical to a mark (numeral) corresponding to the part receiving the ball. If it is determined that they match each other, medals are refunded to the player according to a predetermined rate.

The prior art roulette gaming machine includes a system for collecting a ball from the roulette plate to discharge the ball used in the previous game to the roulette plate again. For example, as disclosed in JP-A-8-229191, a ball passing hole is formed on each ball receiving part of a rotating wheel and a flange for closing the ball passing hole is formed on a fixed wheel. A cut portion is formed in the flange. An open/close plate is provided on the cut portion to open/close the cut portion by driving a solenoid. The cut portion is opened to collect the ball. Accordingly, since there is no need to provide a system for lifting the rotating wheel and the ball is fell down from the wheel, there is disclosed a roulette gaming machine capable of reducing the size of a bucket.

However, the roulette gaming machine disclosed in JP-A-8-229191 requires a complex system for temporarily storing the ball collected from the roulette plate in a lower part of the roulette plate and sending back the ball to the roulette plate.

Also, since each ball receiving part requires an operating unit such as a shutter for opening/closing the ball passing hole, the cost increases and a game may be stopped due to breakdown of the operating unit. Further, the operation and maintenance of the device becomes complex.

Also, since the ball passing hole needs to be formed on each ball receiving part, the ball receiving part is formed to have a predetermined depth so that a part of the ball received in the ball receiving part is covered by the roulette plate. Meanwhile, since the roulette plate needs a discharge opening for discharging the ball to the roulette plate, the roulette plate should be formed to have a height higher than a predetermined height. A detailed example thereof will now be described with reference to FIGS. 30 and 31.

FIGS. 30 and 31 are views showing a roulette device used in the prior art roulette gaming machine. As shown in FIG. 30, the prior art roulette device 100 includes a plurality of ball receiving parts 102 which are formed along a circumferential direction of the roulette plate 101. Also, a ball passing hole 104 is formed on the ball receiving part 102 to collect a ball 103 received in the ball receiving part 102 after the game is terminated. Outside of the ball passing hole 104, a ball collecting part 105 is mounted to collect the ball 103 passing the ball passing hole 104. Meanwhile, a ball discharge hole 107 is formed on a bank passage 106 on which the ball 103 rolls circularly. The ball 103 passing through the ball passing hole 104 is temporarily collected in the ball collecting part 105 and is carried to a ball discharge unit (not shown). Subsequently, the ball sent to the ball discharge unit is discharged from the ball discharge hole 107 to the roulette plate 101 and rolls on the roulette plate 101.

Since the ball passing hole 104 is formed on the ball receiving part 102 to carry the ball 103 to the outside, a height h1 of the ball receiving part 102 is set to be higher than the diameter of the ball 103. Also, a height h2 of the roulette plate 101 should be higher than a predetermined value (e.g., 143 mm) to form the ball discharge hole 107 on the bank passage 106.

Accordingly, as shown in FIG. 31, a game player 109 who playing the game with a game apparatus 108 in which the roulette device 100 is located at a height H1 has a narrow viewing angle $\alpha$ which allows the game player 109 to see the ball 103, regardless of which ball receiving part 102 the ball is received in. Accordingly, a viewing point of the game player 109 should be higher in height than H2. In more detail, if H1=about 900 mm and $\alpha$=50°, H2=about 1400 mm. In this case, a general game player 109 should stand up to view the ball 103 in the roulette plate 101. A game player 109 with a very low viewing point should not only stand up but move to other places to view the ball 103. Accordingly, it is difficult for a game player to view the ball, resulting in decreased entertainment.

SUMMARY OF THE INVENTION

The present invention is made in view of the above-mentioned problems. It is an object of the present invention to provide a roulette device and a game control method that requires no a complex system such as a unit for collecting the ball or a unit for discharging the ball and that facilitates operation and maintenance of the device and reduces the operation and maintenance costs, since the ball can be repeatedly rolled on the roulette plate without having to collect the ball by discharging compressed air to the ball.

It is another object of the present invention to provide a roulette device and a game control method that allows a game player to easily view the ball to thereby increase entertainment, since the depths of the ball receiving part and the roulette plate can be made short.

According to an aspect of the invention, a roulette device includes a roulette plate having a plurality of marks arranged thereon; a ball which rolls on the roulette plate; a plurality of ball receiving parts which are formed corresponding to the marks in a circumferential direction of the roulette plate to receive the ball; a bank passage which is provided on an outer periphery of the ball receiving parts of the roulette plate and on which the ball rolls along a circumferential orbit; a compressor which compresses air; and a first discharge hole which is provided in each ball receiving part and through which the air compressed by the compressor is discharged to the bank passage.

Furthermore, according to another aspect of the invention, there is provided a game control method of allowing a ball to roll on the roulette plate of the above-mentioned roulette device and of allowing the ball to be received in a ball receiving part after an elapse of a predetermined time. The method includes: a step of compressing air by the compressor; and a first air discharging step of discharging the air compressed by the compressor from the first discharge hole provided in the ball receiving part for a predetermined time, so that the ball received in the ball receiving part is sent through the inclined plane toward the bank passage.

Also, according to still another aspect of the invention, a roulette device includes: a roulette plate having a plurality of marks arranged thereon; a ball which rolls on the roulette plate; a plurality of ball receiving parts which are formed corresponding to the marks in a circumferential direction of the roulette plate to receive the ball; and a bank passage which is provided on an outer periphery of the ball receiving parts of the roulette plate and on which the ball rolls along a circumferential orbit. In the roulette device, the roulette plate includes: a central fixing part; a rotating part which is provided in a vicinity of the central fixing part and has the marks and the ball receiving parts thereon; a supporting member which rotatably supports the rotating part with respect to the central fixing part; a drive unit which rotates the rotating part in a predetermined direction with respect to the central fixing part; a compressor which compresses air; a fixed discharge hole which is provided in the central fixing part and through which the air compressed by the compressor is discharged to the ball received in the ball receiving part; a ball detecting unit which, when the ball is received in a specific ball receiving part among the plurality of ball receiving parts, detects the specific ball receiving part having the ball received therein; and a drive control unit which controls the drive unit so that the specific ball receiving part detected by the ball detecting unit is located at a predetermined position where the air is discharged from the fixed discharge hole.

Furthermore, according to a still another aspect of the invention, there is provided a game control method of allowing a ball to roll on the roulette plate of the above-mentioned roulette device and of allowing the ball to be received in a ball receiving part after an elapse of a predetermined time. The method includes: a step of detecting the specific ball receiving part having the ball received therein; a step of controlling the drive unit to rotate the rotating part at a predetermined angle in a predetermined direction with respect to the central fixing part so that the air is discharged from the fixed discharge hole through the specific ball receiving part; a step of compressing air by the compressor; and a first air discharging step of discharging the air compressed by the compressor from the fixed discharge hole through the specific ball receiving part for a predetermined time, so that the ball received in the specific ball receiving part is sent through the inclined plane toward the bank passage.

BRIEF DESCRIPTION OF THE DRAWINGS

These and other objects and advantages of the present invention will be more fully apparent from the following detailed description taken in conjunction with the accompanying drawings, in which.

DETAILED DESCRIPTION OF THE PREFERRED EMBODIMENTS

First and second embodiments on a roulette gaming machine 1 equipped with a roulette device according to the present invention will now be described in detail with reference to the accompanying drawings.

First Embodiment

The roulette gaming machine 1 in accordance with the first embodiment will now be described.

The roulette gaming machine 1 is a gaming machine in which a game player expects numbers to be determined by a roulette device 2 and bets a game medium such as a medal he/she owns on the expected numbers. If the game player wins a bet, the game player can get prizes such as medals from the roulette gaming machine 1.

Figure 1:
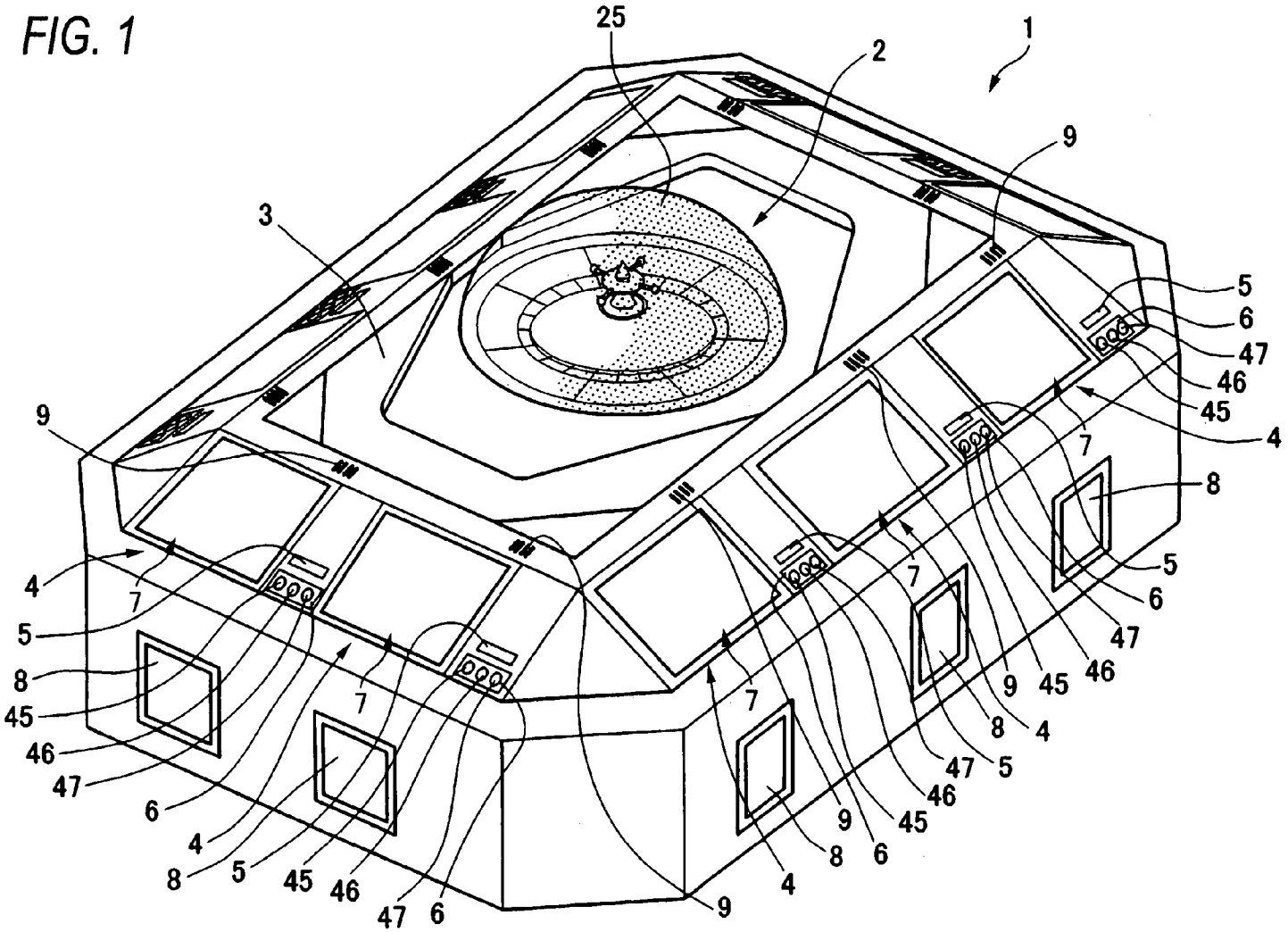
FIG. 1 is a perspective view showing a construction of a roulette gaming machine according to the first embodiment.

A construction of the roulette gaming machine 1 in accordance with the first embodiment will now be described with reference to FIG. 1. FIG. 1 is a perspective view showing a construction of the roulette gaming machine 1 in accordance with the first embodiment.

As shown in FIG. 1, the roulette gaming machine 1 includes a cabinet 3 forming a main body, a roulette device 2 provided in the central portion of an upper side of the cabinet 3, and a plurality of satellites (ten satellites in case of the first embodiment) 4 provided to surround the roulette device 2.

The satellite 4 at least includes a medal insertion slot 5 for inserting game media such as coins or medals used in games, a controller 6 made up of a plurality of control buttons for inputting predetermined orders, and an image display unit 7 for displaying images for games. A game player can operate the controller 6 to play the game while viewing the images on the image display unit 7.

Also, a medal payout opening 8 is provided on the side of the cabinet 3 equipped with the satellite 4. A speaker 9 is provided on the top-left side of the image display unit 7 of the satellite 4 to provide music and sound.

A medal sensor (not shown) is provided inside the medal insertion slot 5 to identify the game media such as medals inserted into the medal insertion slot 5 and to count the number of the inserted medals. Also, a hopper (not shown) is provided inside the medal payout opening 8 to supply the predetermined number of medals through the medal payout opening 8.

Figure 2:
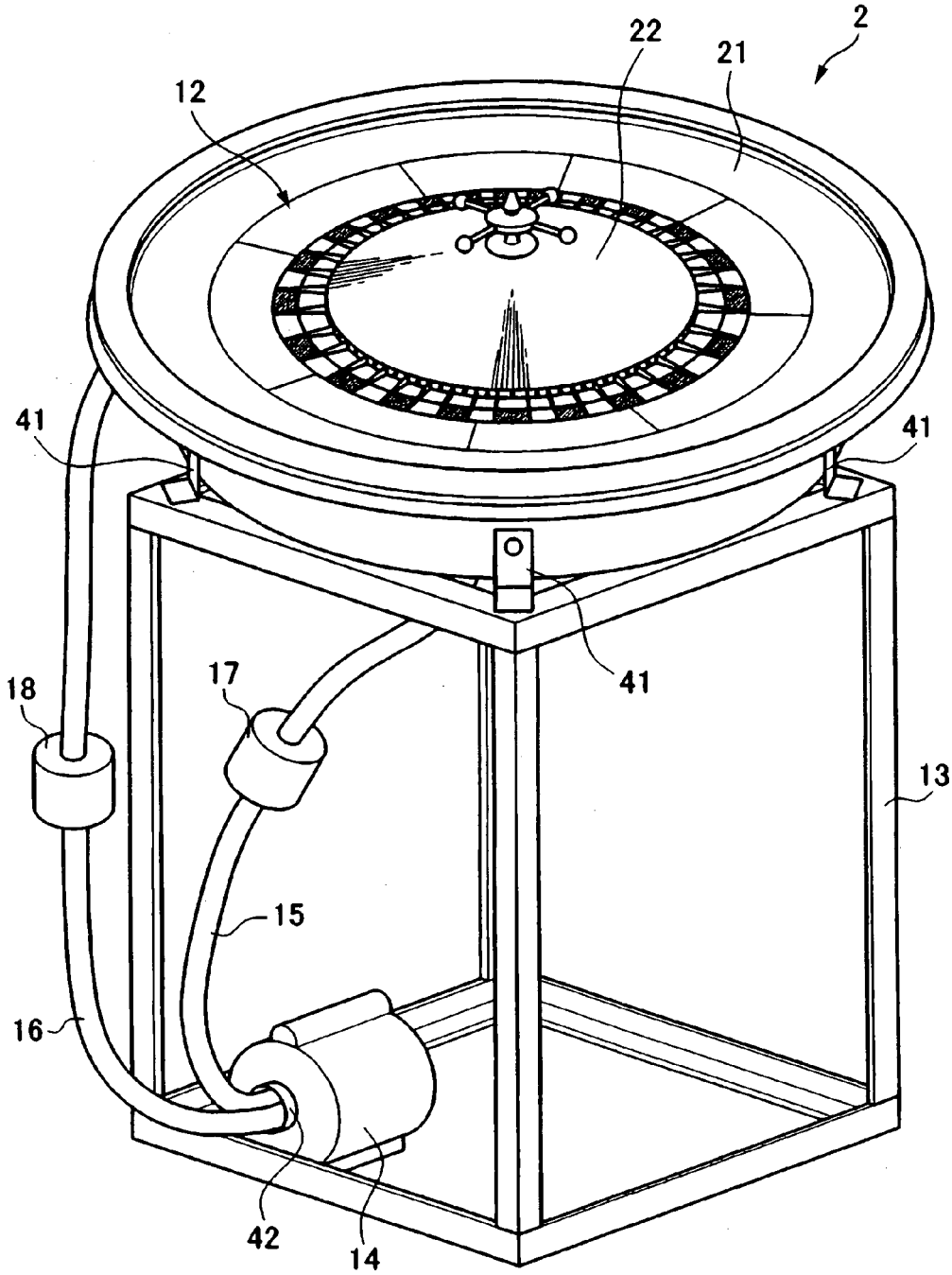
FIG. 2 is a perspective view showing a roulette device according to the first embodiment.
Figure 3:
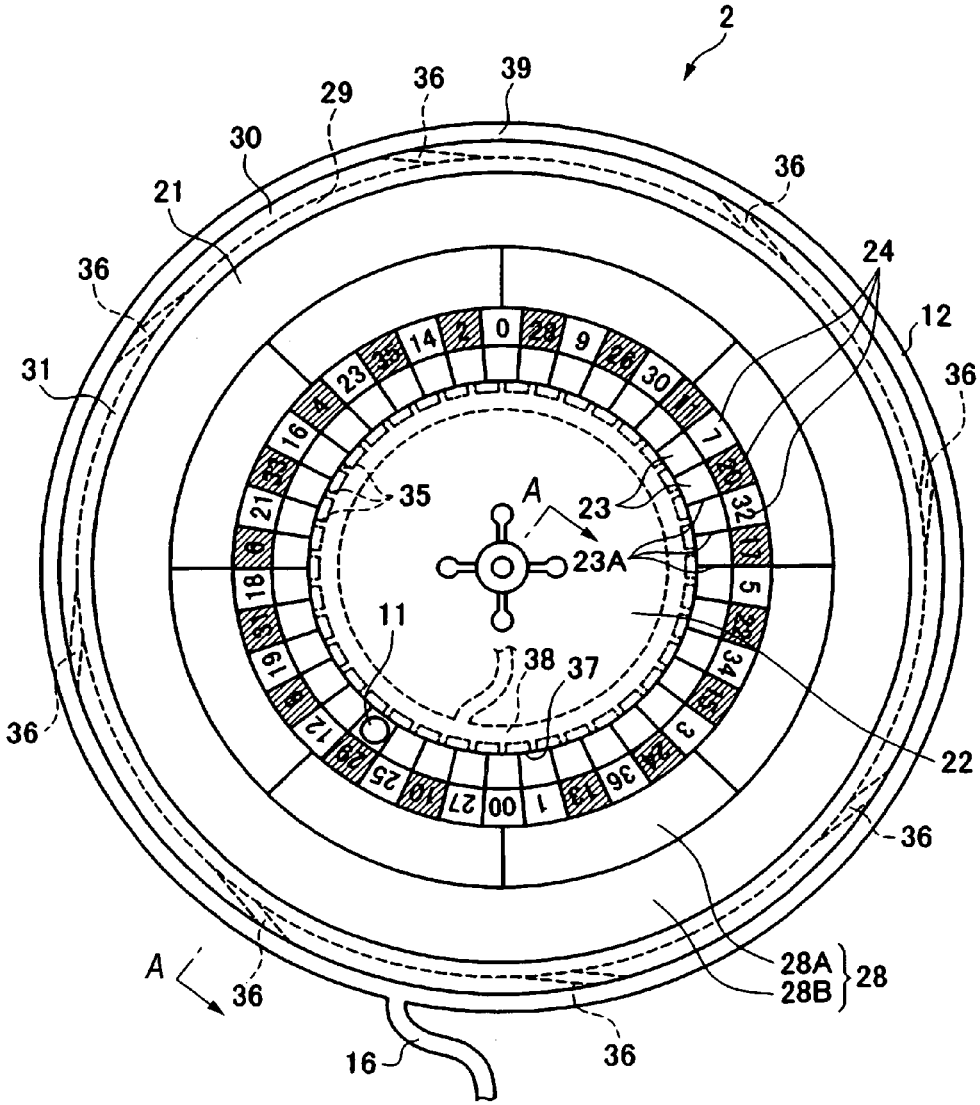
FIG. 3 is a plan view showing a roulette device according to the first embodiment.
Figure 4:
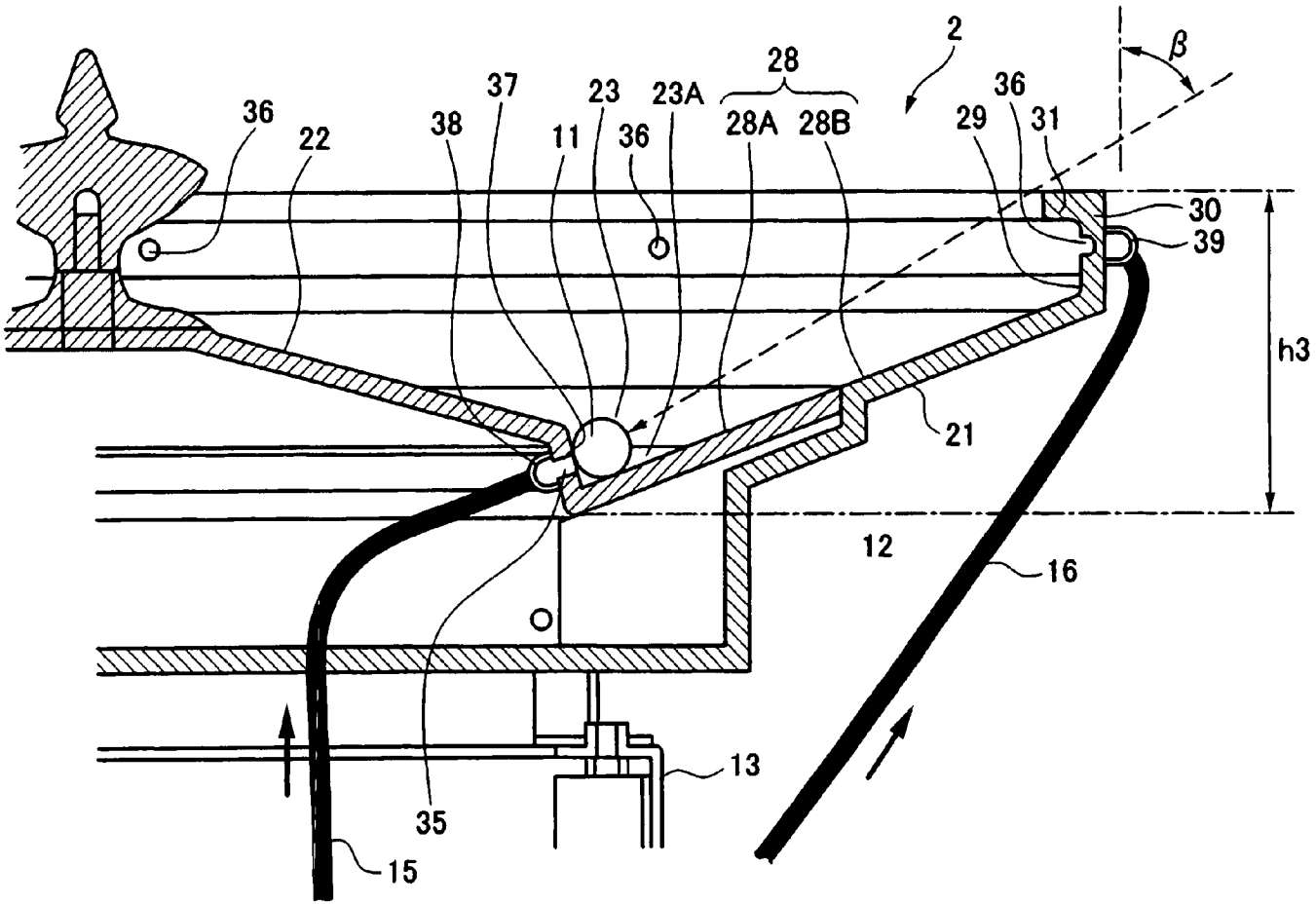
FIG. 4 is a cross-sectional view of the roulette device taken along the line A-A of FIG. 3.
Figure 5:
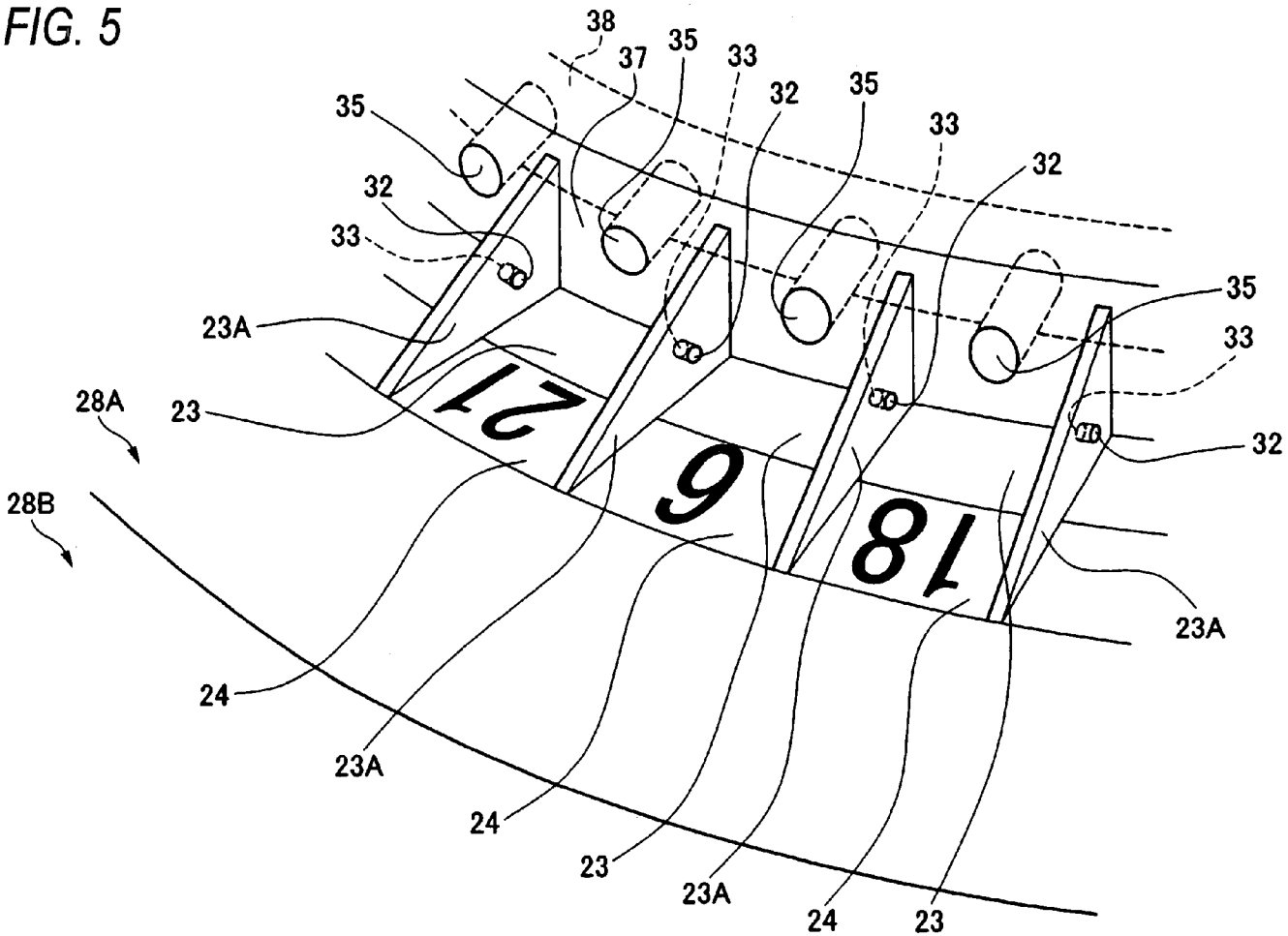
FIG. 5 is an enlarged perspective view of a ball receiving part in a roulette device according to the first embodiment.
Figure 6:
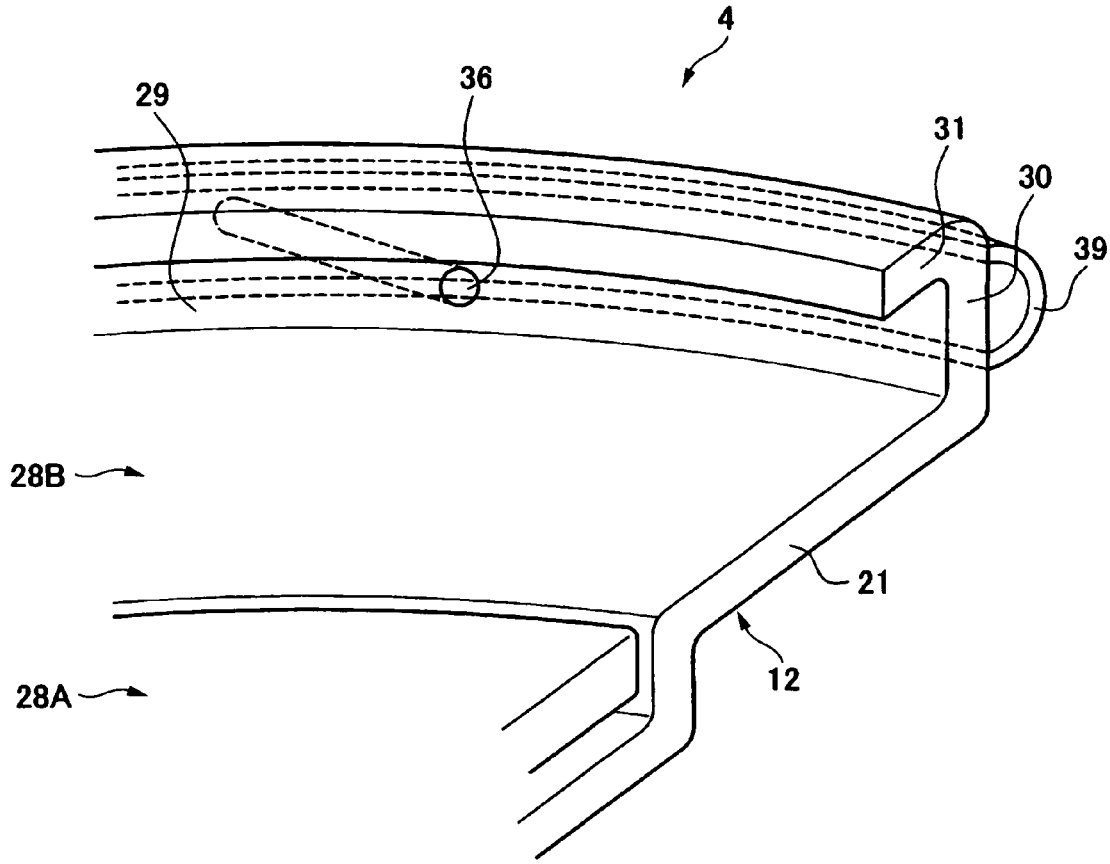
FIG. 6 is an enlarged perspective view of a bank passage in a roulette device according to the first embodiment.

A construction of the roulette device 2 in accordance with the first embodiment will now be described with reference to FIGS. 2 to 6. FIG. 2 is a perspective view showing the roulette device according to the first embodiment. FIG. 3 is a plan view showing the roulette device according to the first embodiment. FIG. 4 is a cross-sectional view of the roulette device taken along the line A-A of FIG. 3. FIG. 5 is an enlarged perspective view showing a ball receiving part of the roulette device according to the first embodiment. FIG. 6 is an enlarged perspective view showing a bank passage of the roulette device according to the first embodiment.

As shown in FIG. 2, the roulette device 2 includes a roulette plate 12 having a rolling area on which a ball 11 rolls during the game, a support 13 for supporting the roulette plate 12 from inside of the roulette gaming machine 1, a compressor 14 for receiving ambient air and compressing the air at a predetermined pressure, air tubes 15, 16 for conveying the air compressed by the compressor 14, and first and second valves 17, 18 each provided in the middle of each of the air tubes 15, 16 to adjust the pressure of air flowing through the respective air tubes 15, 16.

Also, the roulette plate 12 includes a rim 21 fixed to the support 13, and a rotating disk 22 rotatably supported inside the rim 21. A plurality of ball receiving parts 23 (thirty eight ball receiving parts in case of the first embodiment) are formed on the rotating disk 22 in a circumferential direction. The ball receiving parts 23 are partitioned by roughly triangular-shaped partition walls 23A (see FIG. 5). On an upper side of the rotating disk 22 on an outside of each ball receiving part 23, number-indication parts 24 with numerals '0', '00', '1' to '36' are provided corresponding to the respective ball receiving part 23. The rotating disk 22 rotates at a predetermined speed (e.g., $2\pi$ [rad/s] to $0.2\pi$ [rad/s]) in a predetermined direction (e.g., in a clockwise direction) in respect to the rim 21 by means of a drive motor (not shown) provided inside the roulette device 2 during from when the ball 11 starts to roll until a predetermined time interval elapses after the ball 11 is received in the ball receiving part 23.

Also, when provided in the roulette gaming machine 1, the roulette plate 12 is completely covered by a hemisphere-shaped transparent acryl plate 25 (see FIG. 1). Accordingly, the ball 11 can roll on the roulette plate 12 during the game without getting out of the roulette plate 12. Further, this prevents different things from being entering into the roulette plate 12 and prevents deceptive acts.

The rolling area in which the ball 11 actually rolls on the roulette plate 12 is formed to have an inclined plane 28 which is inclined at a predetermined angle (15° in case of the first embodiment) and made up of a first inclined plane 28B formed on an outer periphery of the rim 21 and a second inclined plane 28A formed on an inner periphery of the rotating disk 22. The inclined plane 28 is inclined in an ascending direction from the center of the roulette plate 12 to the outer periphery. The ball receiving part 23 and the bank passage 29 are continuously formed via the inclined plane 28.

Also, a bank passage 29 is provided on an outer periphery of the rim 21. The bank passage 29 is responsible for guiding the ball 11 against the centrifugal force of the ball 11 rolling on the roulette plate 12 to allow the ball 11 to roll along a circumferential orbit. Also, the bank passage 29 is formed with respect to the roulette plate 12 by means of a guide wall 30 provided in a vertical direction. In addition, a wall portion 31 is formed to be continuously connected with the bank passage 29 on an upper side of the outer periphery. The wall portion 31 acts to pressurize the ball 11 rotating along the bank passage 29 so that the ball 11 cannot get out of the roulette plate 12.

The ball 11 is accelerated by air discharged from the following first and second discharge holes 35 and 36 and starts to rotate along the bank passage 29. Meanwhile, if the air is not discharged from the second discharge hole 36, the ball 11 is decelerated and rolls down the inclined plane 28 toward inside of the roulette plate 12, reaching the rotating disk 22 which is rotating.

The ball 11 reaching the rotating disk 22 passes through the number-indication part 24 of the rotating disk 22 and is received in any one of the ball receiving parts 23. A numeral recorded in the number-indication part 24 corresponding to the ball receiving part 23 which has received the ball 11 is a winning number.

Also, a part of the partition wall 23A constituting the ball receiving part 23 is penetrated, and a transmissive light sensor consisting or a light-emitting unit 32 and light-receiving unit 33 is provided on the part of the partition wall 23A (see FIG. 5). Infrared light emitted from the light-emitting unit 32 on one side of the partition wall 23A constituting the ball receiving part 23 reaches the light-receiving unit 33 on the other side of the partition wall 23A. If the ball 11 enters in the ball receiving part 23, the light is blocked, thereby detecting that the ball 11 is present. Accordingly, if the ball 11 enters in a ball receiving part 23, it is detected by the light sensor consisting of the light-emitting unit 32 and the light-receiving unit 33 whether or not the ball 11 is present. The detected result is sent to the following main control CPU 80 (see FIG. 9). The main control CPU 80 determines a winning number based on the result.

Figure 7:
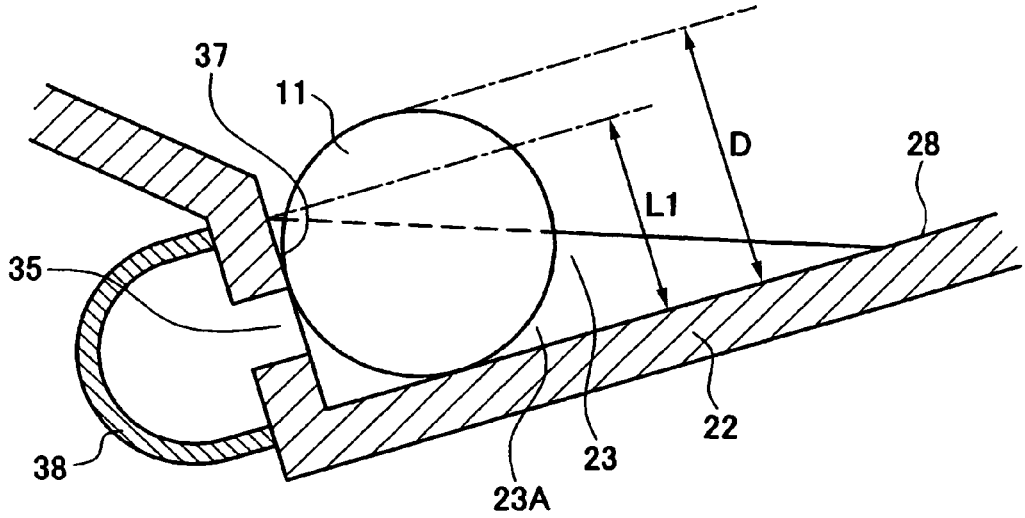
FIG. 7 is a plan view showing a roulette plate according to the first embodiment.

Meanwhile, a depth L1 of the ball receiving part 23 with respect to the inclined plane 28 is formed to be shorter than a diameter D of the ball 11. FIG. 7 is a schematic view showing a ball receiving part according to the first embodiment.

The ball receiving part 23 is a space for receiving the ball 11, which is partitioned by the partition walls 23A into 38 sub-parts in a circumferential direction. As shown in FIG. 7, since the depth L1 of the ball receiving part 23 is formed to be shorter than the diameter D of the ball 11, the ball 11 is not completely covered by the ball receiving part 23 and the ball received in the ball receiving part 23 can be easily found by game players when the ball 11 is received in the ball receiving part 23, resulting in increased entertainment.

As described above, the roulette device 2 according to the first embodiment can make the ball 11 roll repeatedly without the need to take back the ball 11 from the roulette plate 12 by discharging the compressed air to the ball 11, thus not requiring a complex apparatus such as a unit for collecting the ball 11 or a unit for discharging the ball 11. Also, the depth L1 of the ball receiving part 23 can be made shorter than the diameter D of the ball 11 (see FIG. 7). Accordingly, as shown in FIG. 5, a height h3 of the roulette plate 12 can be made lower. Thus, a viewing angle β of the roulette device 2 for a game player to view the ball 11 can be made wide, resulting in increased entertainment.

In addition, since the ball receiving part 23 and the bank passage 29 are continuously formed by an inclined plane 28 inclined in an ascending direction from the ball receiving part 23 to the bank passage 29 at a predetermined angle, the game player can easily locate the ball received in the ball receiving part 23.

Next, the first and second discharge holes 35 and 36 provided in the roulette plate 12 will now be described with respect to FIGS. 5 and 6. The roulette device 2 according to the first embodiment uses air pressure of compressed air to roll the ball 11 on the roulette plate 12. In more detail, the roulette device 2 receives ambient air and compresses the air at a predetermined pressure (e.g., 1 MPa) using a compressor 14 (see FIG. 2) provided below the roulette device 2. The roulette device 2 then conveys the compressed air to the roulette plate 12 via the air tubes 15, 16, and discharges the air from the first and second discharge holes 35 and 36 to apply the air pressure to the ball 11 inside the roulette plate 12.

As shown in FIG. 5, the first discharge hole 35 is provided on an inside wall 37 to correspond to each ball receiving part 23, which is formed by the inside wall 37 and the partition walls 23A. According to the first embodiment, 38 ball receiving parts 23 are formed to correspond to the numerals '0', '00', '1' to '36', and thus thirty-eight first discharge holes 35 are formed. Also, the first discharge holes 35 are formed toward a circumferential direction from the center of the roulette plate 12. The air discharged from the first discharge hole 35 is discharged to the bank passage 29 provided on an outer periphery of the roulette plate 12.

Meanwhile, a ring-shaped discharging air pipe 38 is provided on an opposite side of the inside wall 37 on which the first discharge hole 35 is formed, and is connected to the air tube 15. The thirty-eight first discharge holes 35 are provided on an outer periphery of the discharging air pipe 38. The air conveyed from the air tube 15 flows into the discharging air pipe 38 and is simultaneously discharged from the thirty-eight first discharge holes 35 to the ball receiving part 23. By the air pressure of the discharged air, the ball 11 received in any one of the ball receiving parts 23 starts to roll against the inclined plane 28 toward a direction of the bank passage 29.

As shown in FIG. 6, the second discharge holes 36 are formed on a guide wall 30 constituting the bank passage 29 in a predetermined interval (45° interval in case of the first embodiment). Also, the second discharge holes 36 are formed in a circumferential direction of the bank passage 29, i.e., in a direction tangential to the roulette plate 12. The air discharged from the second discharge holes 36 forms air flow in a clockwise direction along the bank passage 29 of the roulette plate 12 (see FIG. 16).

Meanwhile, a ring-shaped rotating air pipe 39 is provided on an opposite side of the guide wall 30 on which the second discharge hole 36 is formed. The rotating air pipe 39 is connected with the air tube 16. The air carried from the air tube 16 enters in the rotating air pipe 39 and is simultaneously discharged from eight second discharge holes 36. As a result, the ball 11 rolling to the bank passage 29 with the air discharged from the first discharge hole 35 starts to roll in a clockwise direction by the air flow flowing circularly along the bank passage 29.

Also, if the air stops being discharged from the second discharge hole 36, the air flow formed along the bank passage 29 disappears, and the ball 11 is decelerated and loses the centrifugal force. Subsequently, the ball 11 rolls down along the inclined plane 28 to the rotating disk 22 which is rotating. The ball is received in any one of the ball receiving parts 23 provided in the rotating disk 22. As a result, a winning number is determined in the roulette device 2, and the roulette gaming machine 1 supplies medals based on the determined number and bet information and closes the game.

Also, when the air is discharged from the first discharge hole 35, the ball received in the ball receiving part 23 starts to roll again to play the next game without interruption.

Accordingly, rolling and receiving in the ball receiving part 23 can be repeatedly performed without taking back the ball 11 from the roulette plate 12 by applying air pressure of the air discharged from the first and second discharge holes 35 and 36 to the ball 11. Accordingly, there is no need to prepare a complex apparatus such as a unit for collecting the ball 11 or a unit for discharging the ball 11, thus facilitating operation and maintenance of the device and reducing the operation and maintenance costs.

Meanwhile, a rolling system of the ball 11 by use of the first and second discharge holes 36 will be described in detail below.

Also, the support 13 is formed in a rectangular shape by combining a plurality of metallic pillars. The support 13 fixes the roulette plate 12 at a predetermined height by four fixing elements 41 provided at corners on its upper side.

The compressor 14 is provided in an inner space formed in the support 13. The compressor 14 is a device for receiving ambient air and compressing the air at a predetermined pressure (1 Mpa in case of the first embodiment). The compressor 14 according to the first embodiment includes two discharge nozzles 42 for discharging the compressed air. The discharge nozzles 42 are connected to the air tubes 15, 16.

The air tubes 15, 16 carry the air compressed by the compressor 14 to the first and second discharge holes 35 and 36 provided on the roulette plate 12. The first and second valves 17 and 18 are provided in the middle of the air tubes 15, 16. The first and second valves 17 and 18 are electronic valves, which are configured to be able to adjust valve opening times. The first and second valves 17 and 18 are connected to the main control CPU 80 (see FIG. 9), which controls opening/closing times according to a program stored in ROM 81 in advance as described below. Accordingly, by adjusting air pressure of the air discharged from the first and second discharge holes 35 and 36, the ball 11 rolls on the roulette plate 12 and is received in the ball receiving part 23 after a predetermined time has elapsed.

A construction of the controller 6 and an image display device 7 according to the first embodiment will now be described.

As shown in FIG. 1, the controller 6 is provided on the side of the image display device 7 and includes buttons which are manipulated by a game player. In more detail, when viewed from a location opposing to the satellite 4, a BET determination button 45, a CASHOUT button 46, and a HELP button 47 are arranged from the left side.

The BET determination button 45 is pressed when betting is determined after a betting operation is performed through the image display device 7. A game player win a bet when the betting is determined by the game player and the game player makes a bet on a number recorded in the number-indication part 24 corresponding to the ball receiving part 23 in which the ball 11 is received in the roulette device 2. If the game player wins a bet, credits corresponding to the number of the betting chips are added to credits which the game player currently possesses. The betting operation will be described in detail below.

The CASHOUT button 46 is usually pressed when the game is over. When the CASHOUT button 46 is pressed, medals corresponding to credits (in general, 1 medal per credit) acquired and possessed by a game player during the game are refunded from the medal payout opening 8.

The HELP button 47 is pressed when an operating method of the game is not clear. When the HELP button 47 is pressed, a HELP screen displaying for various operation information appears immediately on the image display device 7.

Figure 8:
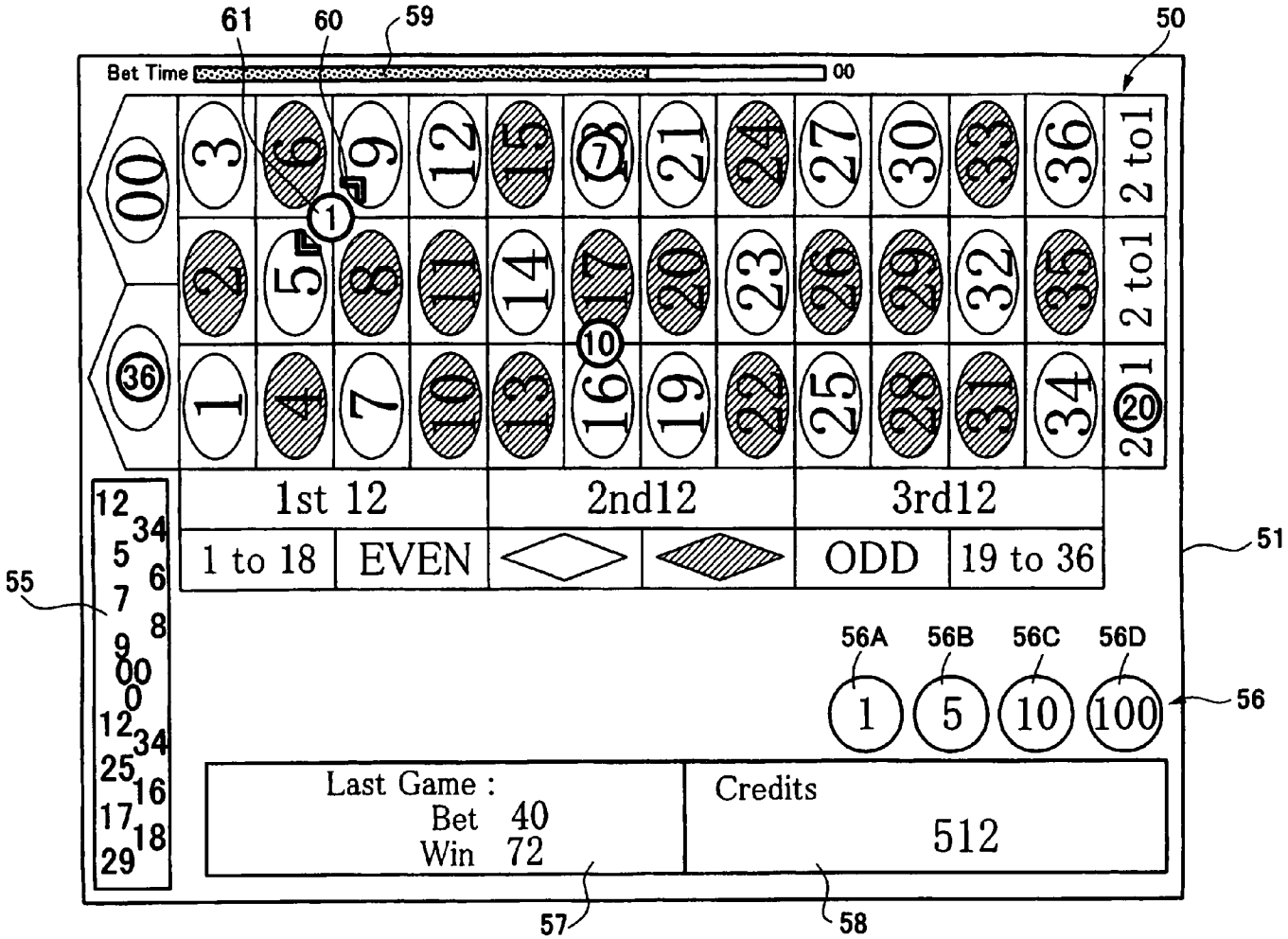
FIG. 8 is a view showing an example of a display screen displayed in an image display device.

Meanwhile, the image display device 7 is a touch panel type liquid crystal monitor equipped with a touch panel 48 on its front side, so that selection is made by touching icons displayed on the liquid crystal display with a finger. FIG. 8 is a view showing an example of a display screen displayed in the image display device during the game.

As shown in FIG. 8, a BET screen 51 having a table type betting board 50 is displayed on the image display device 7 during the game in the roulette gaming machine 1. A game player can operate the BET screen 51 to bet chips using his/her credits.

The BET screen 51 will now be described with reference to FIG. 8. On the table type betting board 50 displayed on the BET screen 51, the same as the numbers '0', '00', '1' to '36' indicated in the number-indication part 24 are arranged in a squared shape. A special BET area is also arranged in a squared shape to specify 'odd number', 'even number', 'color of number-indication part (red or black)', 'predetermined range of numbers (e.g., '1' to '12')' and to bet chips.

Below the table type betting board 50, a result history display part 55, a unit BET button 56, a refund result display part 57, and a number-of-credit display part 58 are sequentially displayed from the left side of the screen.

The result history display part 55 displays a winning number list indicating winning numbers in the past games. In this case, one game implies a sequence of operation in which a game player makes a bet, a ball 11 rolls down to the ball receiving part 23, and credits are paid out according to a winning number. If one game is over, a new winning number is added and displayed so that a history of winning numbers in up to 16 games can be viewed.

Also, the unit BET button 56 is a button which a game player presses to make a bet in his/her specified BET area (on a scale of number and mark, or on a line forming a scale). The unit BET button consists of a 1 BET button 56A, a 5 BET button 56B, a 10 BET button 56C, and a 100 BET button 56D.

The game player first presses a desired BET area on a screen with his/her finger and specifies the BET area with the following cursor 60. When pressing the 1 BET button 56A, the game player bets a chip one by one (the number of bets increases in an order of '1'→'2'→'3' . . . each time the 1 BET button 56A is pressed with a finger). Meanwhile, when the 10 BET button 56C is pressed, the game player can bet the chips by as many as ten (the number of bets increases in an order of '10'→'20'→'30' . . . each time the 10 BET button 56C is pressed with a finger). Also, the 5 BET button 56B and the 100 BET button 56D can be manipulated in the same manner. Accordingly, the game player can bet a large amount of chips with simplified manipulation.

The refund result display part 57 displays the number of chips bet by the game player and the number of refund credits in the previous game. At this time, the number of refund credits minus the number of bet credits is equal to the number of credits which the game player newly acquired in the previous game.

The number-of-credit display part 58 displays the number of credits which the game player currently possesses. The number of credits decreases by the number of bet chips (1 credit per chip) when he/she bets the chips. Also, if the bet number is a winning number, the number of credits increases by as much as refunded credits. If the number of credits possessed by the game player is equal to 0, the game is terminated.

A BET timer graph 59 is provided on an upper side of the table type betting board 50. The BET timer graph 59 is a graph which shows the remaining time the game player can bet. The red graph starts to extend to the right side from the start of the game. When the graph extends to the rightmost, the bet time available in a current game is terminated. Also, when the bet time of a game player is terminated in each satellite 4, i.e., the BET timer graph 59 extends to the rightmost, air is discharged from the first discharge hole 35 to start to roll the ball 11 received in the ball receiving part 23.

On the table type betting board 50, a cursor 60 is displayed to indicate a BET area which the game player currently selects. Also, a chip mark 61 is displayed to indicate the number of chips and BET areas which are bet until the current time. A numeral displayed on the chip mark 61 indicates the number of bet chips. For example, as shown in FIG. 8, the chip mark 61 of '7' placed in the scale of '18' implies that seven chips are being bet on the number '18'. Such a method of betting on only a single number is called a ⌈straight up betting⌋ method.

The chip mark 61 of '1' placed in an intersecting point of the scales '5', '6', '8', and '9' implies that a single chip is simultaneously bet on the four numbers '5', '6', '8', and '9'. Such a method of betting on the four numbers is called a 'corner betting' method.

Examples of other betting methods include the following methods: a 'split betting' method of covering two numbers on a line between the two numbers, a 'street betting' method of covering three numbers (e.g., '13', '14', and '15') located on a line (on a vertical line of FIG. 8), a 'five betting' method of covering five numbers of '0', '00', '1', '2', '3' on a line between numbers '00' and '3', a 'line betting' method of covering six numbers (e.g., '13', '14', '15', '16', '17', and '18') on two lines (on two vertical lines of FIG. 8), a 'column betting' method of covering twelve numbers on a scale written as '2 to 1', and a 'dozen betting' method of covering twelve numbers on each scale written as '1st 12', '2nd 12', or '3rd 12'. In addition, there is another betting method of covering eighteen numbers according to colors of the number-indication part, odd or even numbers, or numbers 18 or less or 19 or more by using six scales provided on the bottom of the table type betting board 50.

When the game player makes a bet on the BET screen 51 thus configured, the game player specifies the bet BET area (on a scale of number and mark, or on a line forming a scale) on a screen and presses it with his/her finger directly. As a result, the cursor 60 moves to the specified BET area.

When the respective unit buttons (1 BET button 56A, 5 BET button 56B, 10 BET button 56C, and 100 BET button 56D) of the unit BET button 56 are pressed, medals corresponding to the respective units are bet on the specified BET area. For example, when the 10 BET button 56C is pressed four times, the 5 BET button 56B is pressed one time, and the 1 BET button 56A is pressed three times, the total 48 medals can be bet.

Figure 9:
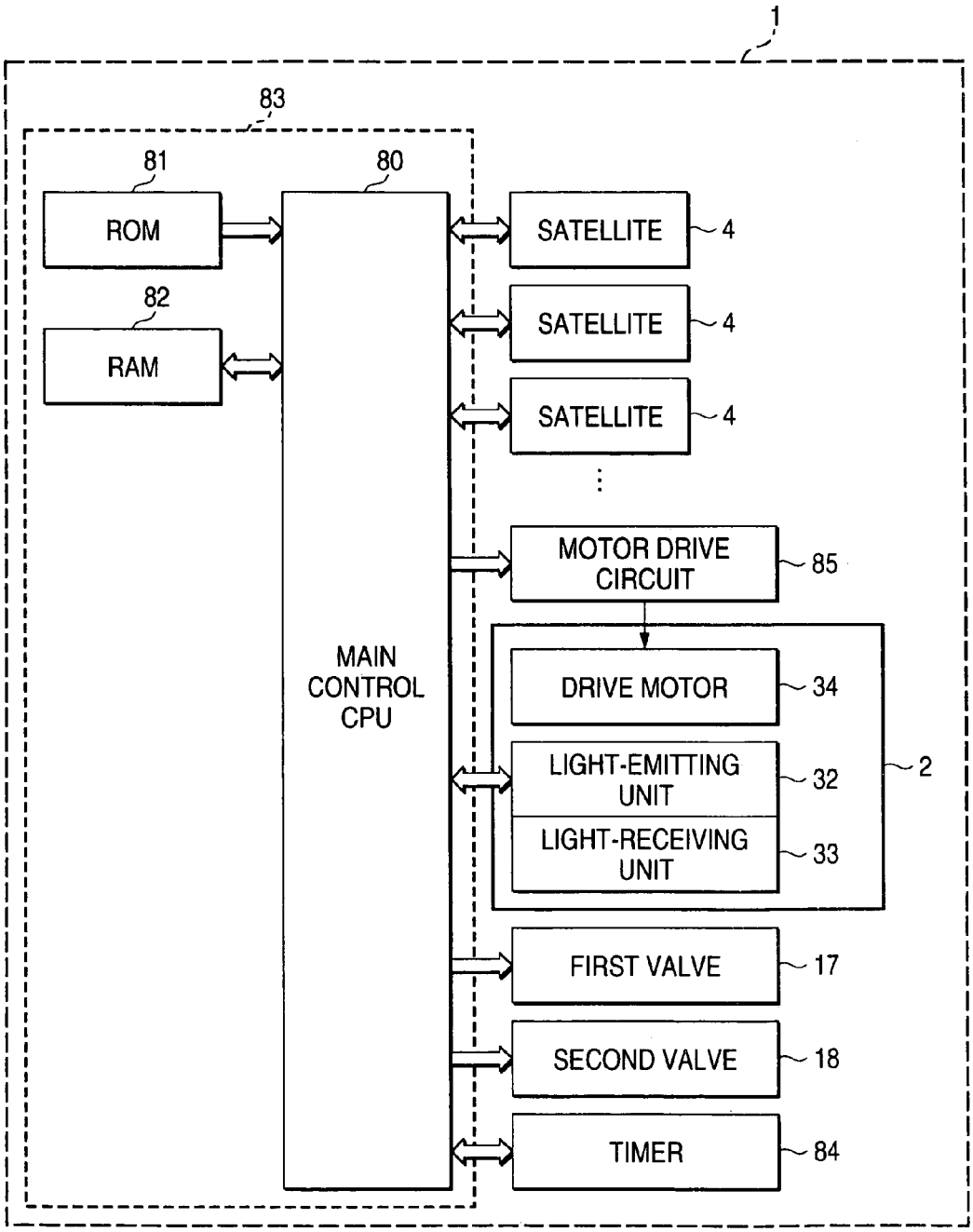
FIG. 9 is a block diagram showing a control system of a roulette gaming machine according to the first embodiment.

A construction of a control system of the roulette gaming machine 1 according to the first embodiment will now be described with reference to FIG. 9. FIG. 9 is a block diagram showing a control system of the roulette gaming machine.

As shown in FIG. 9, the roulette gaming machine 1 includes a main controller 83 having a main control CPU 80, a ROM 81, and a RAM 82, a roulette device 2 connected to the main controller 83, ten satellites 4 (see FIG. 1), and first and second valves 17 and 18. A control system of the satellite 4 will be described below in detail.

The main control CPU 80 processes various operations based on an input signal and the like applied from each satellite 4, and data or program stored in ROM 81 and RAM 82. The main control CPU 80 sends an order signal to the satellite 4 based on the processed result, whereby it controls each satellite 4. Also, the main control CPU 80 controls the light-emitting unit 32 and the light-receiving unit 33 (see FIG. 5) provided on the roulette device 2 to determine a winning number of the ball receiving part 23 to which the ball 11 rolls down. In addition, the main control CPU 80 determines whether or not a game player wins a bet and calculates the number of credits to be paid based on the obtained winning number and bet information transmitted from the each satellite 4.

The ROM 81 consists of, for example, a semiconductor memory and the like, and stores program for implementing basic functions of the roulette gaming machine 1, program for controlling elements in the roulette device 2 and the first and second valves 17 and 18, odds (the number of credits-to-be-paid per chip) for a typical roulette game using the BET screen 51, and program for controlling each satellites 4.

Meanwhile, the RAM 82 temporarily stores bet information of chips supplied from each satellite 4, a winning number of the roulette device 2 determined by the light-emitting unit 32 and the light-receiving unit 33, and data on results of processes executed by the main control CPU 80.

Also, the main control CPU 80 is connected to the first valve 17 and the second valve 18 for adjusting air pressure in the air tubes 15, 16. By opening the first valve 17, the air compressed by the compressor 14 (see FIG. 2) is discharged from the first discharge hole 35 provided in the ball receiving part 23. Also, by opening the second valve 18, the air compressed by the compressor 14 is discharged from the second discharge hole 36 provided in the bank passage 29.

When the bet time of the game player is terminated in each satellite 4, i.e., when the BET timer graph 59 of the BET screen 51 reaches the rightmost point, the first valve 17 is opened during a predetermined time interval (2 seconds in case of the first embodiment). Accordingly, the ball 11 received in the ball receiving part 23 at the termination time of the previous game rolls toward the bank passage 29 by application of air pressure.

Subsequently, the second valve 18 is opened to form air flow flowing along the bank passage 29 of the roulette plate 12. The ball 11 which rolls on the bank passage by the air pressure applied from the first discharge hole 35 rotates on the bank passage 29 in a clockwise direction with the air flow.

Next, when the second valve 18 is closed after a predetermined time interval (15 seconds in case of the first embodiment), the air flow discharged from the second discharge hole 36 is stopped and the ball 11 is decelerated slowly, so that the ball 11 rolls down along the inclined plane 28 and is received in the ball receiving part 23.

The main control CPU 80 is connected to the light-emitting unit 32 and the light-receiving unit 33 provided in the roulette device 2. The light-emitting unit 32 and the light-receiving unit 33 are provided in each ball receiving part 23 as described above. If the ball 11 enters into the ball receiving part 23, the light is blocked, thereby detecting whether or not the ball 11 is present. Accordingly, when the ball 11 enters into the ball receiving part 23, it is detected by a light sensor consisting of the light-emitting unit 32 and the light-receiving unit 33, thereby transmitting it to the main control CPU 80. The main control CPU 80 determines the winning number based on the result.

Also, the main control CPU 80 is connected via a motor drive circuit 85 to a drive motor 34 which drives the rotating disk 22 of the roulette plate 12. During from when the ball 11 starts to roll until a predetermined time interval elapses after the ball 11 is received in the ball receiving part 23, the main control CPU 80 controls the drive motor 34 so that the rotating disk 22 rotates at a predetermined speed (e.g., $2\pi$ [rad/s]) in a predetermined direction (e.g., in a clockwise direction) with respect to the rim 21.

The main control CPU 80 is also connected to a timer 84 for measuring time. Time information of the timer 84 is transmitted to the main control CPU 80. The main control CPU 80 opens/closes the first and second valves 17 and 18 according to the time information of the timer 84 as described below.

Figure 11:
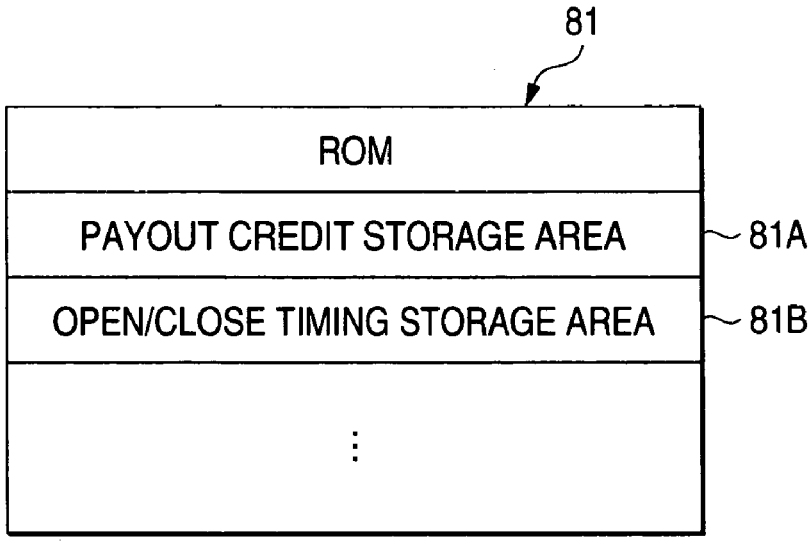
FIG. 11 is a view showing a ROM storage area of a roulette gaming machine according to the first embodiment.
Figure 12:
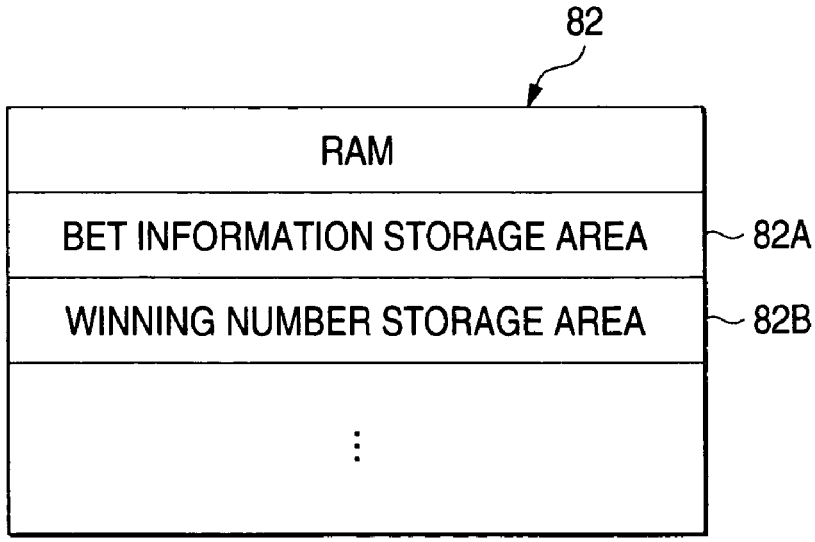
FIG. 12 is a view showing a RAM storage area of a roulette gaming machine according to the first embodiment.

As shown in FIG. 11, the ROM 81 includes a payout credit storage area 81A storing odds in respect to the roulette game using the BET screen 51, and an open/close timing storage area 81B storing open/close timing of the first and second valves 17 and 18. The odds for each BET area of the BET screen 51 stored in the payout credit storage area 81A has a payout of '×2' to '×36' according to betting methods ('straight up', 'corner betting', 'split betting', and the like).

Figure 13:
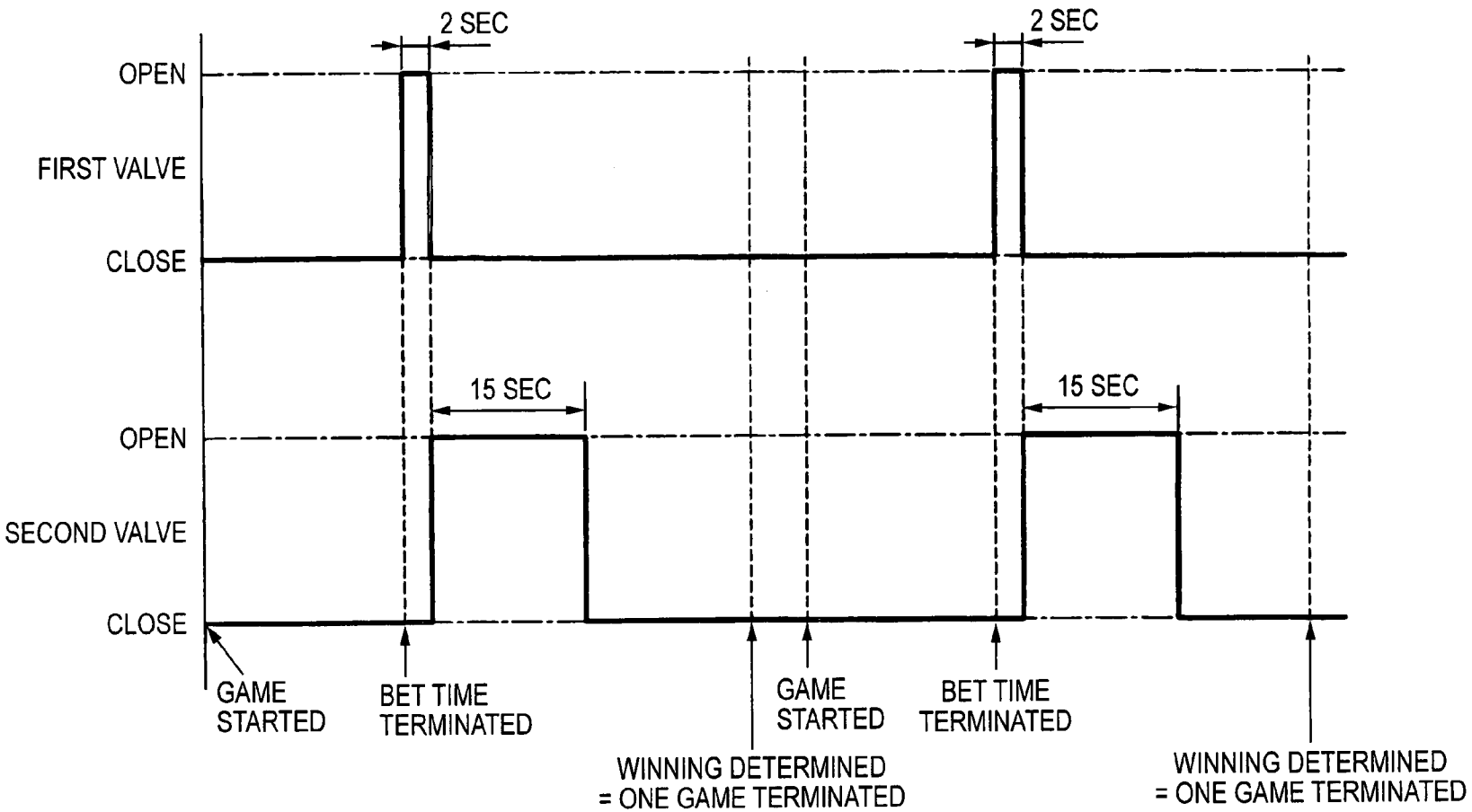
FIG. 13 is a timing diagram of first and second valves.

The open/close timing of the first and second valves 17 and 18 stored in an open/close timing storage area 81B will now be described with respect to FIG. 13. FIG. 13 is a view showing open/close timing of the first and second valves.

As shown in FIG. 13, when a game starts, the bet time for which a game player bets chips in each satellite 4 is initiated. When the bet time is terminated (the BET timer graph 59 of the BET screen 51 reaches the rightmost point), the main control CPU 80 opens the first valve 17 for a predetermined time period. Subsequently, the control CPU 80 opens the second valve 18 to form a ring-shaped air flow flowing along the bank passage 29 of the roulette plate 12 (see FIG. 16). The ball 11 which rolls to a direction of the bank passage 29 by air pressure applied from the first discharge hole 35 rotates on the bank passage 29 in a clockwise direction with the air flow.

After a predetermined time interval (15 seconds in case of the first embodiment), the main control CPU 80 closes the second valve 18. The air discharged from the second discharge hole 36 is stopped so that the rotating speed of the ball 11 decreases. The ball 11 rolls down along the inclined plane 28 and is finally received in the ball receiving part 23. A winning number is determined by a light sensor consisting of the light-emitting unit 32 and the light-receiving unit 33 and medals are then given, whereby one game is terminated. When a game starts again, the bet time of the satellite 4 is initiated. When the bet time is terminated, the main control CPU 80 opens the first valve 17. A roulette game process program according to the open/close timing of the first and second valves will be described below in detail with reference to a flow chart (see FIG. 14).

Also, the RAM 82 includes a bet information storage area 82A for storing bet information of a current game player during the game, and a winning number storage area 82B for storing a winning number of the roulette plate 12 determined by the light-emitting unit 32 and the light-receiving unit 33. The bet information represents a specified BET area and the number of bet chips in the BET screen 51.

Figure 10:
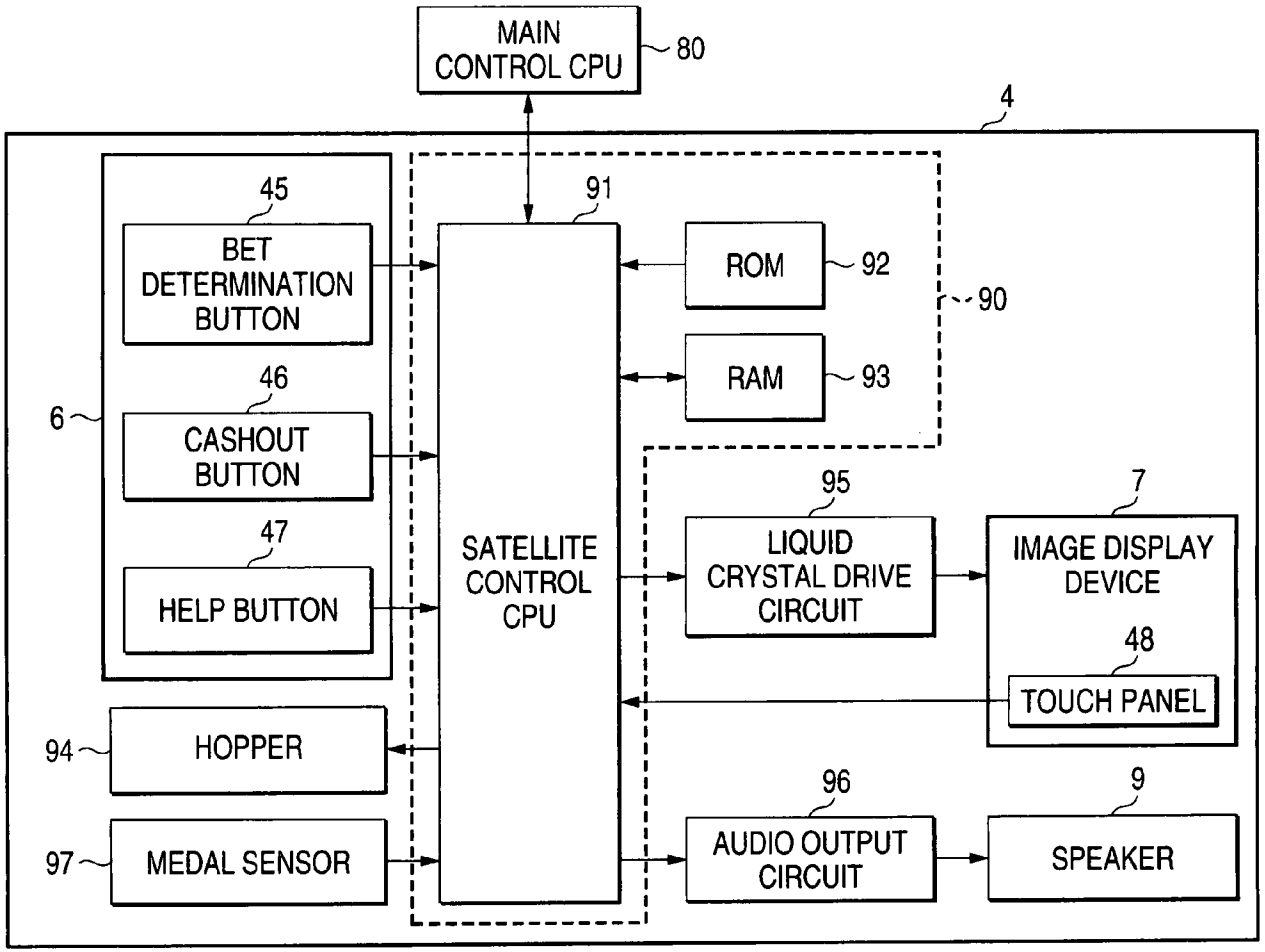
FIG. 10 is a block diagram showing a control system of a satellite according to the first embodiment.

Next, a construction of a control system of the satellite 4 connected to the CPU 80 of the main controller 83 according to the first embodiment will now be described with reference to FIG. 10. FIG. 10 is a block diagram showing a control system of a satellite according to the first embodiment. Each of the ten satellites 4 basically has the same construction and a single satellite 4 will thus be exemplarily described.

As shown in FIG. 10, the satellite 4 includes a satellite controller 90 and several peripheral devices. The satellite controller 90 includes a satellite control CPU 91, ROM 92, and RAM 93. The ROM 92 consists of, for example, semiconductor memory, and stores program for implementing basic functions of the satellite 4, various program necessary for controlling the satellite 4, and data tables. Also, the RAM 93 temporarily stores data processed by the satellite control CPU 91, the number of credits possessed by a current game player, and a chip betting condition by the game player.

The satellite control CPU 91 is also connected to the BET determination button 45, the CASHOUT button 46, and the HELP button 47, which are provided in the controller 6 (see FIG. 1). The satellite control CPU 91 controls so that various operations can be performed based on operation signals outputted by pressing each button. In more detail, the satellite control CPU 91 performs various processes based on input signals supplied from the controller 6, and data or programs stored in ROM 92 and RAM 93, and transmits the resultant data to the main control CPU 80 of the main controller 83.

Meanwhile, the satellite control CPU 91 receives command signals from the main control CPU 80, controls peripheral devices constituting the satellite 4, and performs the roulette game in the satellite 4. Also, the satellite control CPU 91 receives signals from the game player and performs various processes based on input signals supplied from the controller 6 and data or programs stored in ROM 92 and RAM 93. Based on the processed result, the satellite control CPU 91 controls the peripheral devices constituting the satellite 4 and performs the roulette game in the satellite 4. Also, processing methods depend on processing conditions. For example, a process of giving medals for a winning number is a former process, while a process in which a game player manipulates betting on the BET screen 51 is a latter one.

The satellite control CPU 91 is also connected to a hopper 94. According to command signals from the satellite control CPU 91, the hopper 94 supplies the predetermined number of medals through the medal payout opening 8 (see FIG. 1).

Also, the satellite control CPU 91 is connected to the image display device 7 through the liquid crystal drive circuit 95. The liquid crystal drive circuit 95 includes a program ROM, an image ROM, an image control CPU, a work RAM, a VDP, and a video RAM. The program ROM stores image control programs for the image display device 7 or various selection tables. Also, the image ROM stores, for example, dot data for forming images displayed on the image display device 7. Also, the image control CPU determines images to be displayed on the image display device 7 based on parameters set by the satellite control CPU 91 among the dot data stored in the image ROM in advance according to the image control program stored in the program ROM. Also, the work RAM includes temporary storage means when the image control program is run by the image control CPU. The VDP forms images according to display determined in the image control CPU, and outputs it to the image display device 7. Meanwhile, the video RAM acts as temporary storage means when images are formed by the VDP.

Also, as described above, the touch panel 48 is mounted on the front side of the image display device 7, and information manipulated on the touch panel 48 is transmitted to the satellite control CPU 91. On the touch panel 48, a chip betting operation of a game player is performed in the BET screen 51. In more detail, selection of BET areas and manipulation of the unit BET button 56 are performed by manipulating the touch panel 48. The information is transmitted to the satellite control CPU 91. Based on the information, bet information (specified BET area and number of bet chips in the BET screen 51) of a current game player is stored in the RAM 93. The bet information is transmitted to the main control CPU 80 and stored in the bet information storage area 82A of the RAM 82.

Also, an audio output circuit 96 and a speaker 9 are connected to the satellite control CPU 91. The speaker 9 produces various effect sounds based on output signals from the audio output circuit 96.

Also, the medal sensor 97 is connected to the satellite control CPU 91. The medal sensor 97 detects medals inserted from the medal insertion slot 5 (see FIG. 1), calculates the inserted medals, and transmits the result to the satellite control CPU 91. The satellite control CPU 91 increases the number of credits of a game player stored in the RAM 93 based on the transmitted signal.

Figure 14:
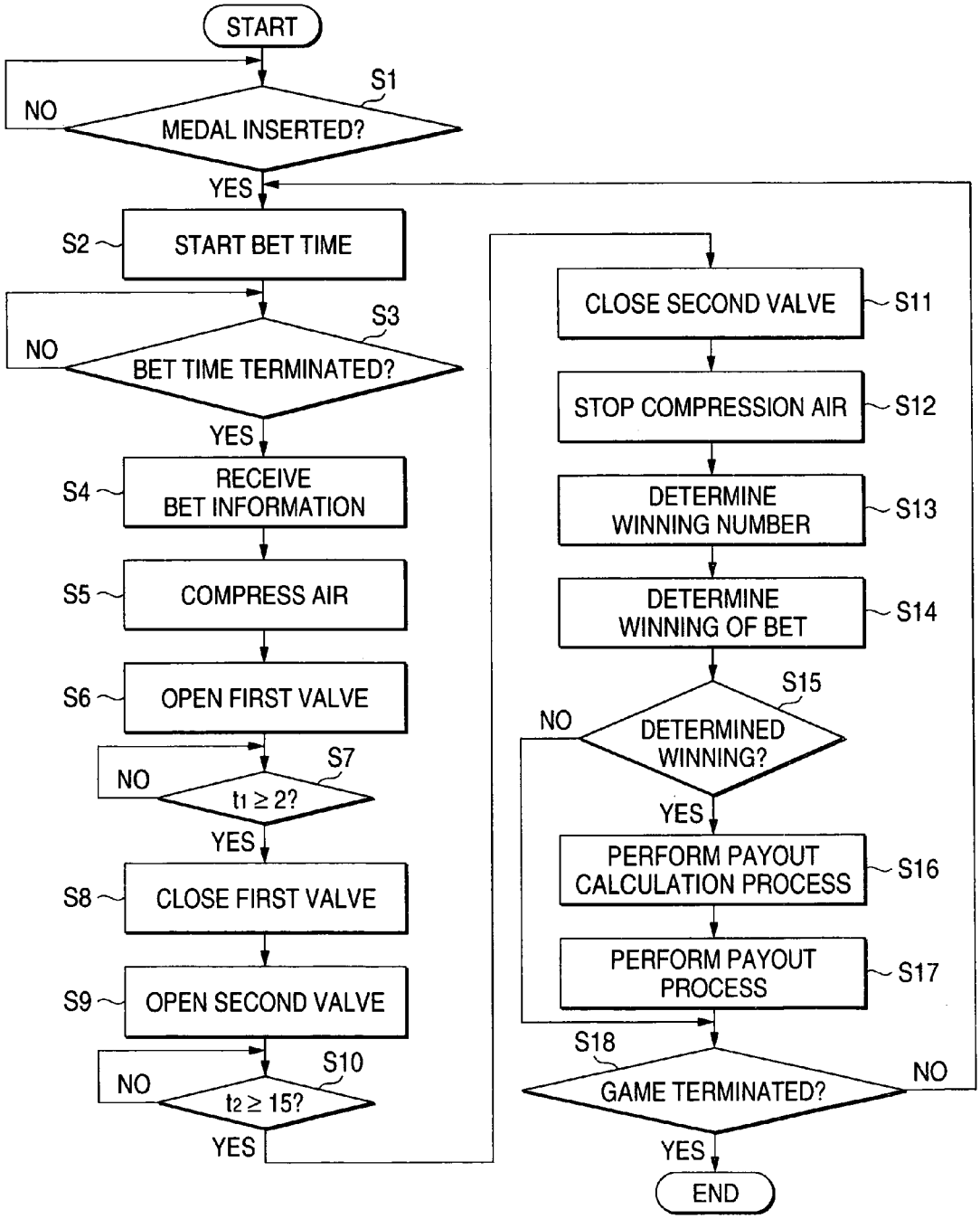
FIG. 14 is a flow chart of a typical roulette game process program according to the first embodiment.

A game process program in the roulette gaming machine 1 according to the first embodiment will now be described with reference to FIG. 14. FIG. 14 is a flow chart of a roulette game process program in the roulette gaming machine 1 according to the first embodiment. The programs shown in the flow chart of FIG. 14 is stored in the ROM 81 or RAM 82 which is provided in the roulette gaming machine 1 and run by the main control CPU 80.

In step S1, the main control CPU 80 determines whether or not medals or coins are inserted by a game player. In the roulette gaming machine 1 according to the first embodiment, when medals or coins are inserted to the medal insertion slot 5 in a single satellite 4, the medal sensor 97 detects and transmits it to the satellite control CPU 91. Subsequently, a medal insertion signal is sent from the satellite 4 to the main controller 83. The main control CPU 80 determines whether or not the game player inserts medals or coins. If the medals or coins are determined not to have been inserted (S1: NO), it waits until they are inserted. If the medals or coins are determined to have been inserted (S1: YES), it proceeds to step S2. Also, if the medals or coins are inserted, the satellite controller 90 records credit data corresponding to the amount of inserted coins on the RAM 93.

Also, the BET screen 51 shown in FIG. 8 is displayed on the image display device 7 of the satellite 4 used by the game player so that the game player can bet chips. Another game player can join the game during the game. Up to ten game players can play the game in the roulette gaming machine 1 according to the first embodiment.

Subsequently, when a first game player inserts medals or coins, the bet time is initiated (step S2). The bet time is a period in which a game player can bet. If a current game continues to be played following the previous game, the bet time is continuously initiated after the previous game is terminated. During the bet time, the game player taking part in the game can operate the touch panel 48 to bet his/her chips on a BET area related to his/her desired number (see FIG. 8). A detailed betting method using the BET screen 51 is already described above.

Next, in step S3, it is determined whether or not the bet time is terminated. The bet time is indicated by the BET timer graph 59 where a red graph extends to the right side from when the bet time is initiated (step S2). When the red graph extends to the rightmost point, the bet time is terminated in the current game.

Before the bet time is terminated (S3: NO), a game player is allowed to make a bet. If the bet time is terminated (S3: YES), a bet termination signal is outputted to the satellite controller 90 of the satellite 4 and an image indicating that the bet time is terminated is displayed on a liquid crystal display of the satellite 4 so that a game player is not permitted to make a bet on the touch panel 48. The bet information (specified BET areas and number of chips bet on the specified BET areas) of the game player in the satellites 4 is received (step S4) and stored in the bet information storage area 82A of the RAM 82.

Figure 15:
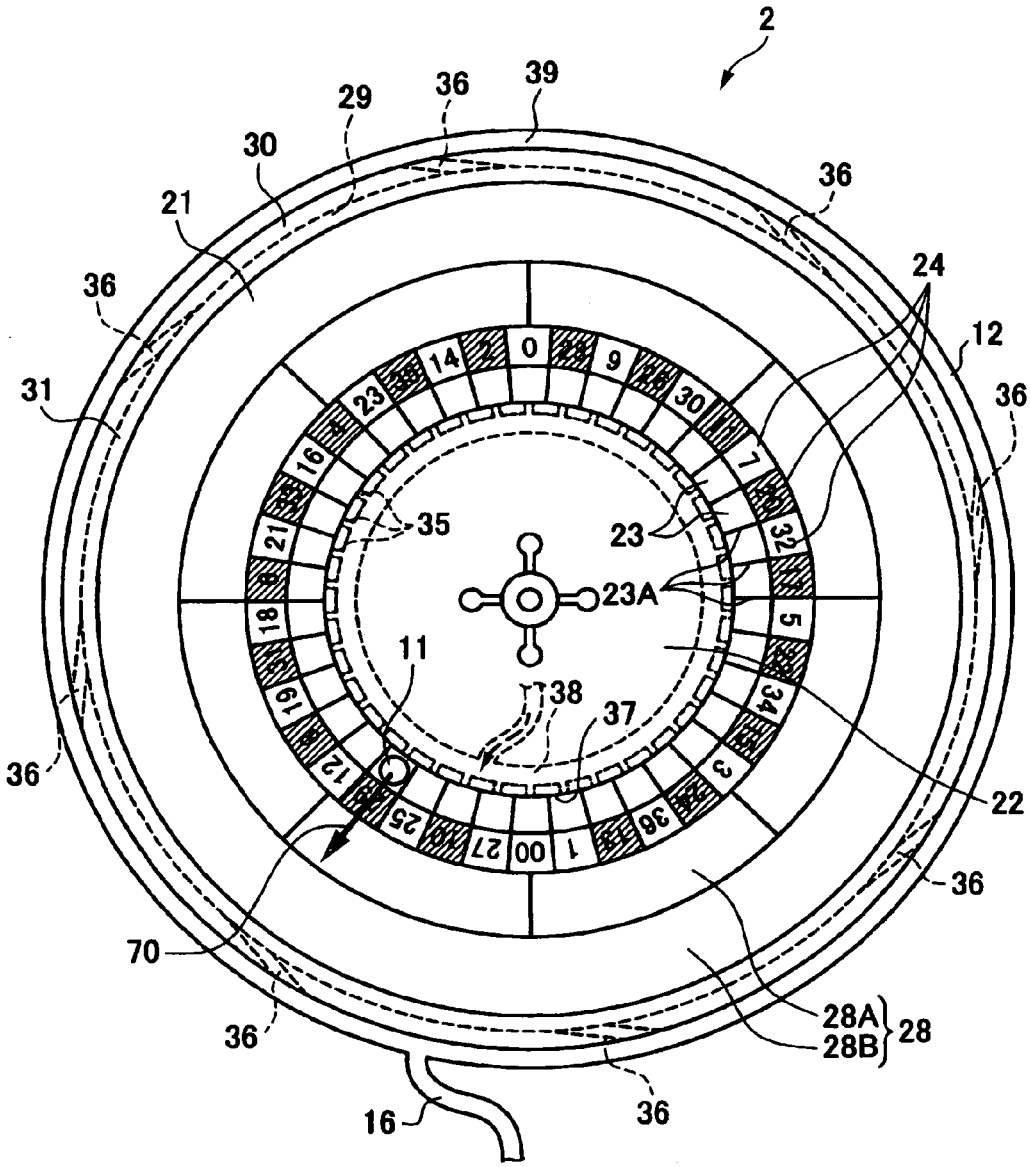
FIG. 15 is a view showing a ball rolling in a roulette device in step S6.

The main control CPU 80 draws lots through the roulette device 2 according to the game program. In step S5, the compressor 14 is powered on to compress the air. Next, the first valve 17 is opened (step S6). The first valve 17 is provided on the air tube 15 which carries the air compressed by the compressor 14 to the first discharge hole 35 so that air pressure of the air passing through the air tube 15 can be controlled. When the first valve 17 is opened, the compressed air begins to be discharged from the first discharge hole 35. The air pressure is applied to a ball 11 received in any one of the ball receiving parts 23 so that the ball 11 rolls to the bank passage 29. FIG. 15 is a view showing the ball rolling in the roulette device in step S6.

As shown in FIG. 15, in step S6, if the first valve 17 is opened, the ball 11 received in the ball receiving part 23 rolls toward the bank passage 29 (in a direction of arrow 70) by air pressure from the first discharge hole 35 provided in the ball receiving part 23.

Next, in step S7, it is determined whether or not a predetermined time (2 seconds in case of the first embodiment) has elapsed after the first valve 17 is opened. The elapsed time is measured by a timer 84 connected to the main control CPU 80. If the measured value t1 is less than two seconds after the first valve 17 is opened (S7: NO), the first valve 17 is still opened.

Meanwhile, if the measured value t1 is two seconds or more after the first valve 17 is opened (S7: YES), it proceeds to step S8.

Figure 16:
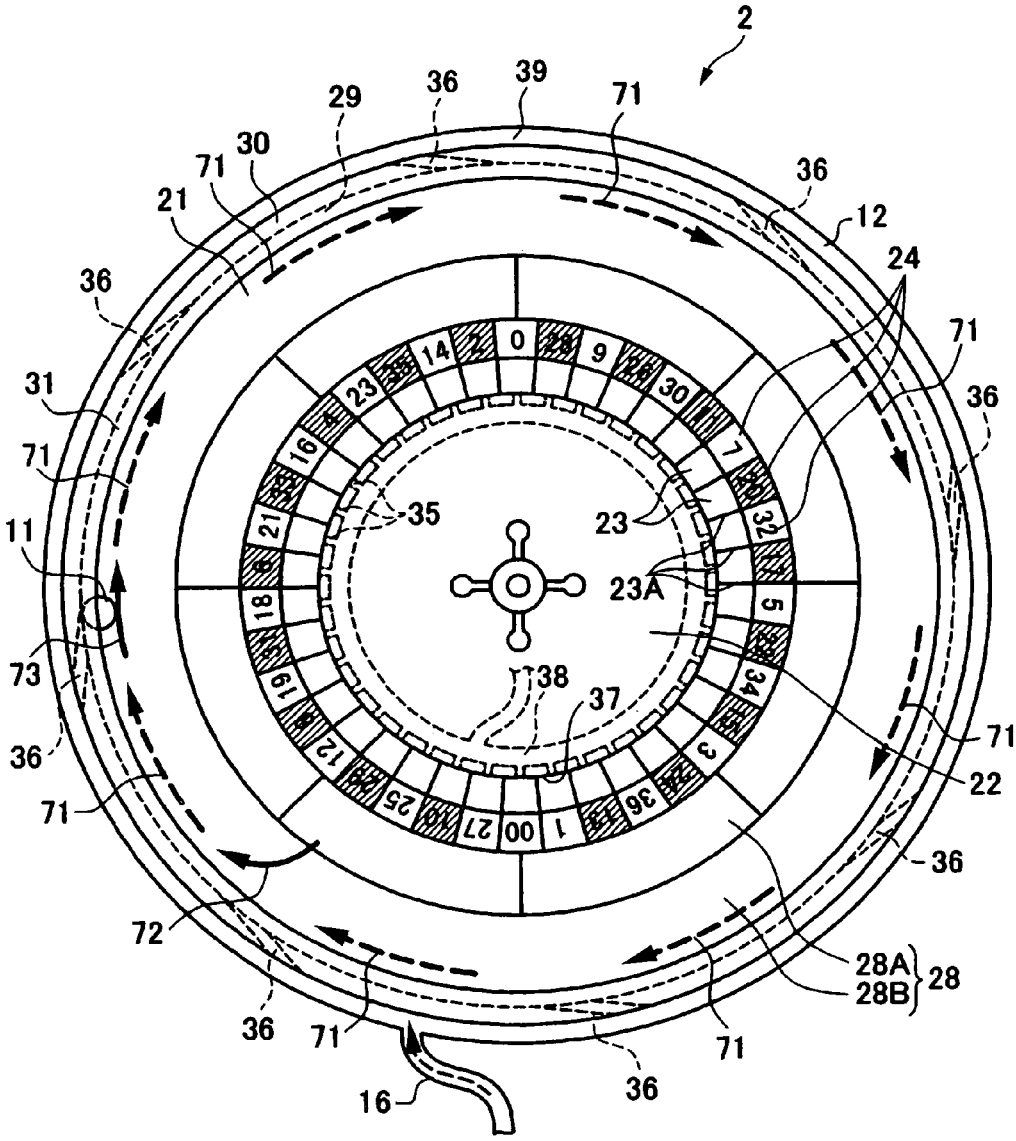
FIG. 16 is a view showing a ball rolling in a roulette device in step S9.

In step S8, the main control CPU 80 closes the first valve 17, and stops air-discharging from the first discharge hole 35. In step S9, the main control CPU 80 opens the second valve 18. The second valve 18 is provided on the air tube 16 carrying air compressed by the compressor 14 to the second discharge hole 36 and controls air pressure of the air passing through the air tube 16. If the second valve 18 is opened, the compressed air starts to be discharged from the second discharge hole 36. Accordingly, air flow flowing along the bank passage 29 in a clockwise direction is produced, and the ball 11 rolling to the bank passage 29 in step S6 starts to rotate along a circular orbit with the applied air pressure. FIG. 16 is a view showing the ball rotating in the roulette device in step S9.

As shown in FIG. 16, in step S8, if the second valve 18 is opened, the air flow flowing in a clockwise direction (in a direction of arrow 71) along the bank passage 29 on the roulette plate 12 is produced by the air discharged from the second discharge hole 36 provided on the bank passage 29. The ball 11 rolling to the direction of the bank passage 29 by the air pressure from the first discharge hole 35 is changed in its rolling direction to a circumferential direction of the roulette plate 12 by the air pressure from the second discharge hole 36 (see the arrow 72). The ball 11 to which the air pressure from the second discharge hole 36 is applied rolls to an outer periphery of the roulette plate 12 by the centrifugal force and starts to roll along the bank passage 29 (see the arrow 73). The bank passage 29 guides the ball 11 against the centrifugal force of the ball 1 rolling on the roulette plate 12 so that the ball can rotate along a circular orbit. A wall portion 31 is formed to be continuous to the bank passage 29 on an upper side of the outer periphery. Accordingly, it is not apprehended that the ball 11 rotating on the bank passage 29 gets out of the roulette plate 12.

In step S10, it is determined whether or not a predetermined time (15 seconds in case of the first embodiment) has elapsed after the second valve 18 is opened. The elapsed time is measured by a timer 84 connected to the main control CPU 80. If the measured value t2 is less than 15 seconds after the second valve 18 is opened (S10: NO), the second valve 18 continues to be opened.

Meanwhile, if the measured value t2 is 15 seconds or more after the second valve 18 is opened (S10: YES), it proceeds to step S1.

In step S11, the main control CPU 80 closes the second valve 18, and stops air-discharging from the second discharge hole 36. In step S12, the compressor 14 is powered off to stop compressing the air.

Figure 17:
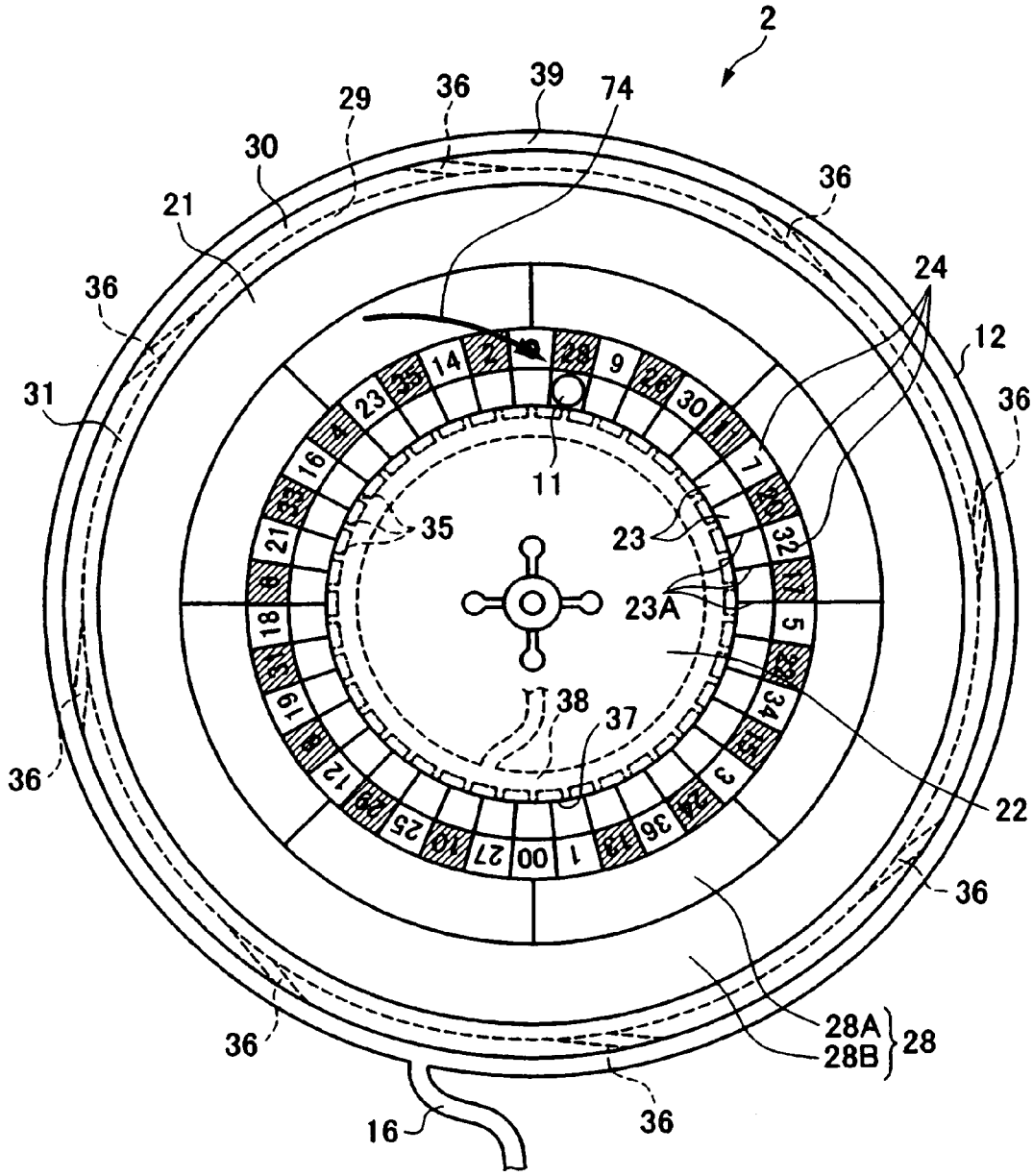
FIG. 17 is a view showing a ball rolling in a roulette device in step S11.

When the air is not discharged from the second discharge hole 36, the ball 11 rolling along the bank passage 29 is decelerated and finally rolls down along the inclined plane 28 to a central portion of the roulette plate 12, reaching the rotating disk 22. FIG. 17 is a view showing the ball rolling in the roulette device in step S11.

As shown in FIG. 17, in step S11, if the second valve 18 is closed, the air discharged from the second discharge hole 36 provided on the bank passage 29 is not provided, so that the ball 11 is decelerated. Since the speed and centrifugal force of the ball 11 are decreased, the ball 11 rolls to the central portion from the bank passage 29 along a circular orbit on the inclined plane 28. The ball 11 finally reaches the rotating disk 22 (see the arrow 74).

The ball 11 rolling to a direction of the rotating disk 22 passes through the number-indication part 24 located on the outside of the rotating disk 22 and is received in any one of the ball receiving parts 23. A numeral (any one of '0', '00', and '1' to '36') written on the number-indication part 24 corresponding to the ball receiving part 23 in which the ball 11 is received is a winning number.

After the ball 11 is received in the ball receiving part 23, it is detected by the light-emitting unit 32 and the light-receiving unit 33 which ball receiving part the ball 11 has been received in, and the main control CPU 80 determines a winning number (any one of '0', '00', and '1' to '36' (step S13).

Also, the main control CPU 80 determines whether or not chips bet in each satellite 4 have been determined the winning from the bet information of each satellite 4 received in step S4 and the winning number determined in step S13 (step S14).

It is determined whether or not the chips bet in at least one of the satellites 4 have been determined the winning based on the winning determination of step S13 (step S15). If the chips have been determined the winning (step S15: YES), the main control CPU 80 performs a payout calculation process (step S16). In the payout calculation process, the won chips are recognized in each satellite 4, and a total sum of the payout of the credits given to each satellite 4 is calculated using the odds (number of credits-to-be-paid per chip) for the BET area stored in the payout credit storage area 81A of the ROM 81. Subsequently, it proceeds to step S17.

Meanwhile, if it is determined that there are no won chips in each satellite 4 (S15: NO), it proceeds to step S18.

In step S17, a credit payout process is performed based on the payout calculation process in step S16. When the credit is paid to the satellite 4, credit data corresponding to the payout amount is output from the main controller 83 to the satellite controller 90 of the won satellite 4. The credit data is added to the RAM 93 of corresponding satellite 4.

In step S18, it is determined whether or not a game continues to be played in at least one of the satellites 4. A game player usually presses the CASHOUT button 46 when terminating the game. When the CASHOUT button 46 is pressed, medals (normally, one medal per credit) corresponding to credits which are acquired and possessed by a current game player are refunded through the medal payout opening 8 via the hopper 94.

When a game continues to be played in any one of the satellites 4 (S18: NO), it returns to step S2 so that the bet time is initiated again to perform the next game.

Meanwhile, when the game is terminated in all the satellites 4 (S18: YES), a corresponding roulette game process is terminated.

As described above, in the roulette gaming machine 1 according to the first embodiment, the first discharge hole 35, which discharges the air compressed by the compressor 14, is provided on the ball receiving part 23 of the roulette plate 12 in the roulette device 2 to roll the ball 11 received in the ball receiving part 23 toward the bank passage 29 by air pressure of the air discharged from the first discharge hole 35. In addition, the second discharge hole 36 which discharges air compressed by the compressor 14 to a circumferential direction of the bank passage 29 is provided to rotate the ball 11, which rolls on the bank passage 29, in a circumferential direction along the bank passage 29 by air pressure of the air discharged from the second discharge hole 36. Accordingly, a process of rolling the ball 11 on the roulette plate 12 and receiving the ball 11 in the ball receiving par 23 can be repeatedly performed without the need to take back the ball 11 from the roulette plate 12, thus not requiring a complex apparatus such as a unit for collecting the ball 11 or a unit for discharging the ball 11 and facilitating operation and maintenance of the device and reducing the operation and maintenance costs. In addition, since the depths of the ball receiving part 23 and the roulette plate 12 can be made short, the viewing angle β (see FIG. 4) is wide enough for a game player to locate the ball 11 regardless of which ball receiving part 23 the ball 11 is received in, resulting in increased entertainment.

The ball receiving part 23 and the bank passage 29 are continuously formed through an inclined plane 28 which is inclined at a predetermined angle in an ascending direction from the ball receiving part 23 to the bank passage 29. Accordingly, a game player can easily locate the ball 11 received in the ball receiving part 23, resulting in increased entertainment.

Also, the wall portion 31 is formed to be continuous to the bank passage 29 on its outer periphery. Accordingly, it is not apprehended that the ball 11 rotating on the bank passage 29 gets out of the roulette plate 12.

Also, since the depth L1 of the ball receiving part 23 is formed to be shorter than the diameter D of the ball 11, the ball 11 is not completely covered by the ball receiving part 23 and the ball received in the ball receiving part 23 can be easily found by game players when the ball 11 is received in the ball receiving part 23.

Second Embodiment

A roulette gaming machine 201 in accordance with a second embodiment will now be described with reference to FIGS. 18 to 29. In the following description about the second embodiment, the same reference numerals of elements constituting the roulette gaming machine 1 according to the first embodiment shown in FIGS. 1 to 17 denote the same elements constituting the roulette gaming machine 1 according to the first embodiment.

A construction of the roulette gaming machine 201 according to the second embodiment is almost the same as that of the roulette gaming machine 1 according to the first embodiment. In addition, control processes of the roulette gaming machine 201 according to the second embodiment are the same as those of the roulette gaming machine 1 according to the first embodiment.

However, the roulette gaming machine 201 according to the second embodiment is different in the following terms from the roulette gaming machine 1 according to the first embodiment.

Figure 20:
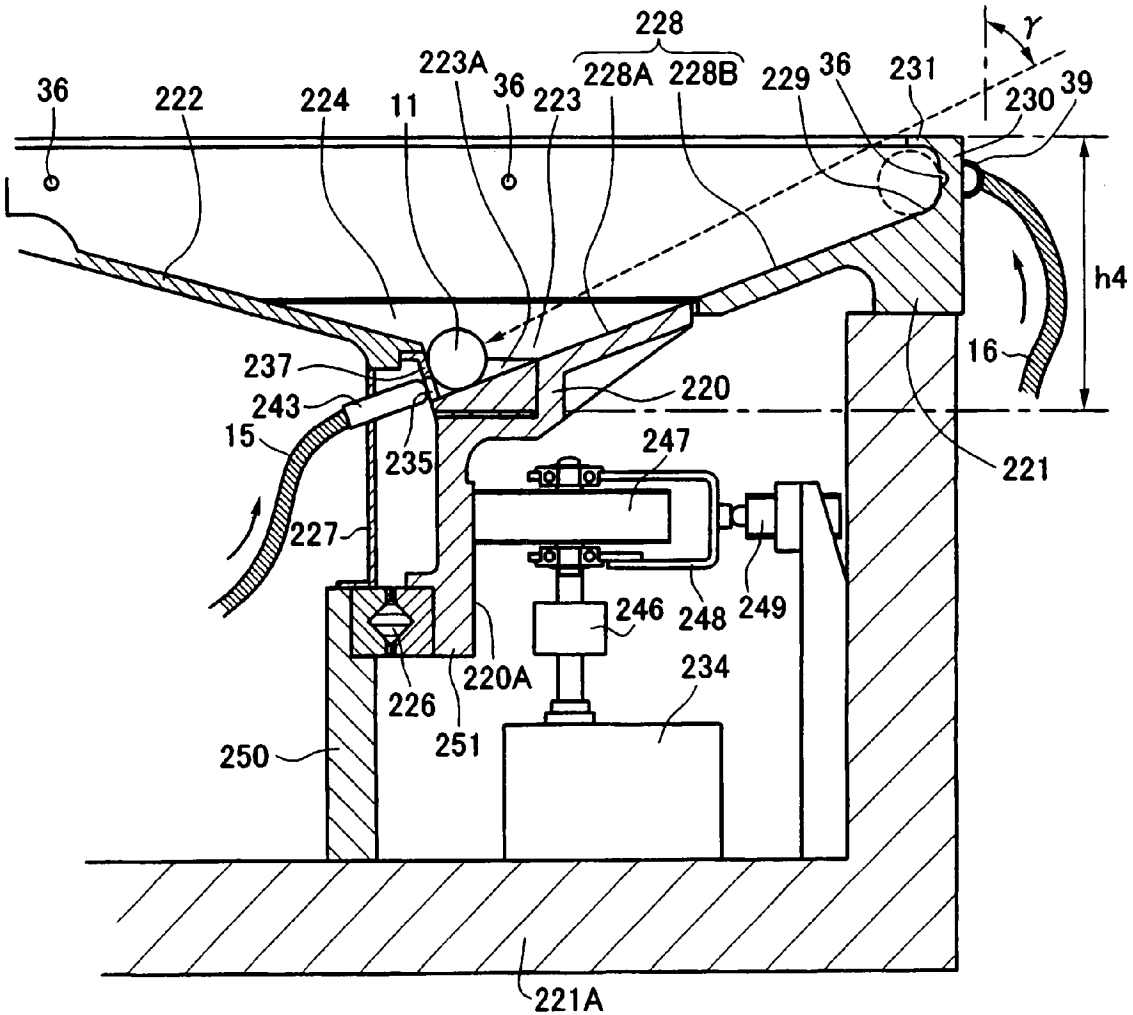
FIG. 20 is a cross-sectional view of the roulette device taken along the line B-B of FIG. 19.

First, the roulette gaming machine 1 according to the first embodiment is configured such that the rotating disk 22 which is provided in the central portion of the roulette plate 12 and has the ball receiving part 23 is entirely supported to be rotatable in respect to the rim 21 (see FIG. 4), while the roulette gaming machine 201 according to the second embodiment has a central fixing part 222 fixedly supported in respect to a rim 221 on a central portion of a roulette plate 212, a rotating part 220 which has a circular ring shape and is rotatably supported via a cross ball bearing 226 in respect to the central fixing part 222, and a ball receiving part 223 provided on the rotating part 220 (see FIG. 20). That is, the second embodiment is different from the first embodiment in that a central portion of the roulette plate 212 is always fixed and only the ball receiving part 223 provided along a circumferential direction is rotated.

Figure 19:
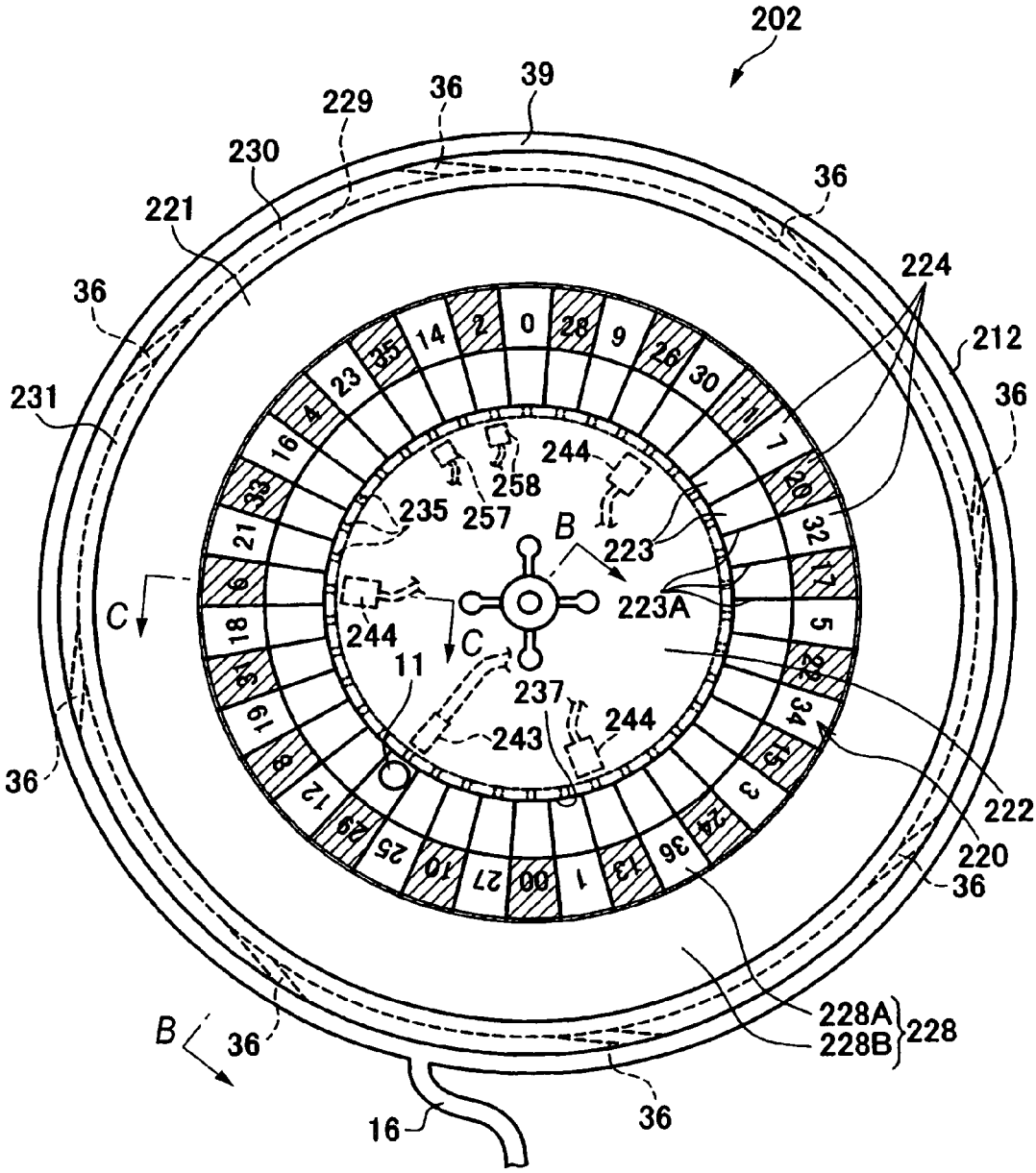
FIG. 19 is a plan view showing a roulette device according to the second embodiment.

Secondly, the roulette gaming machine 1 according to the first embodiment includes the first discharge hole 35 for discharging air compressed by the compressor 14 to discharge the received ball 11 and detection sensors 32, 33 for detecting the ball receiving part receiving the ball 11 in respect to the respective ball receiving parts 23 (thirty-eight ball receiving parts in case of the first embodiment), while the roulette gaming machine 201 according to the second embodiment includes a fixed discharge hole 243 for discharging compressed air and three ball detection sensors for detecting the ball 11 on the central fixing part 222 fixedly supported at a central portion of the roulette plate 212 (see FIG. 19). The second embodiment is different from the first embodiment in that the ball 11 received in the ball receiving part 223 is discharged according to the following procedure: First, the rotating part 220 is rotated after rolling the ball 11. The ball detection sensor 244 detects which ball receiving part 223 the ball 11 is received in. The rotating part 220 is rotated such that the detected ball receiving part 223 is located in front of the fixed discharge hole 243. The air is discharged to discharge the ball 11 received in the ball receiving part 223.

Figure 18:
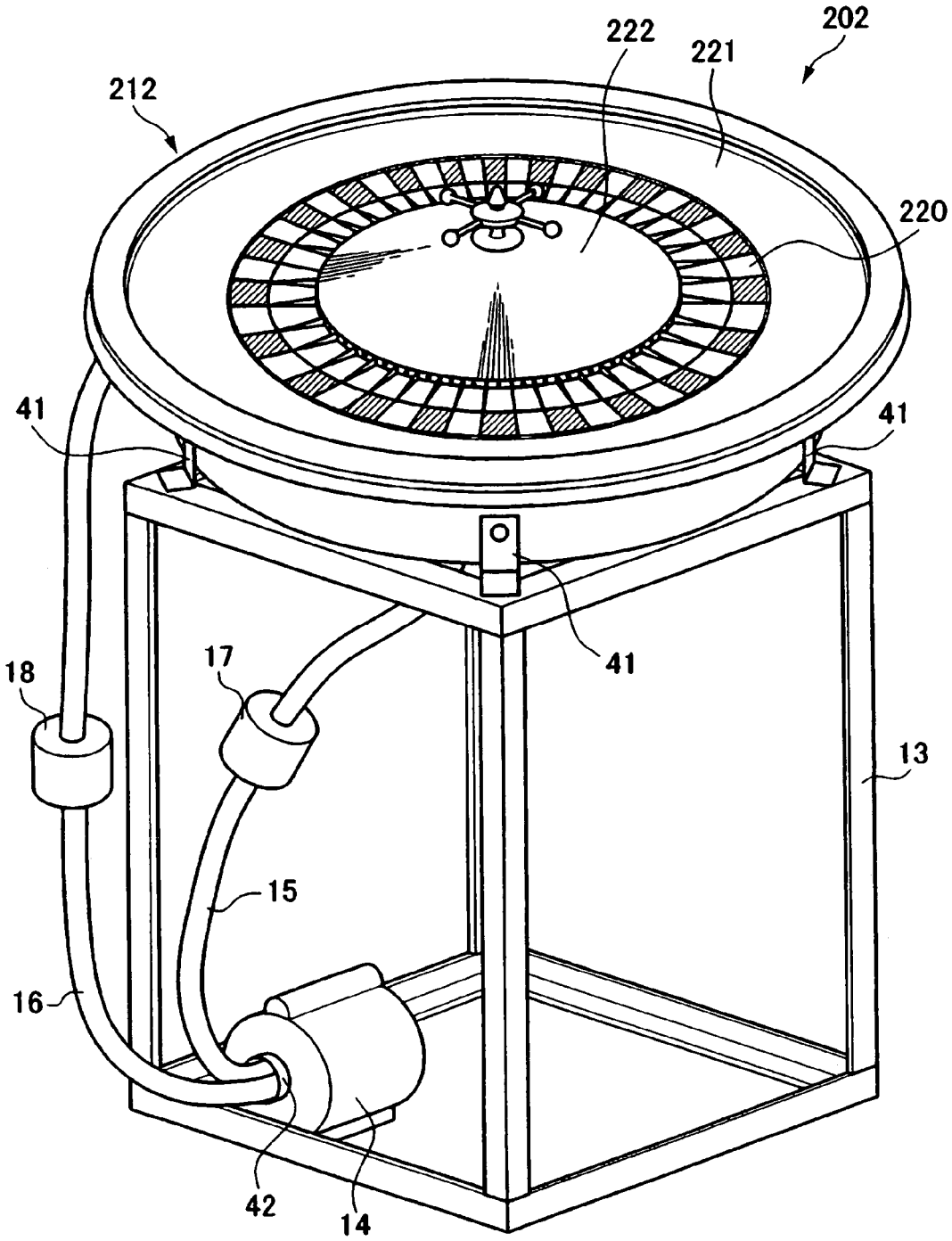
FIG. 18 is a perspective view showing a roulette device according to the second embodiment.
Figure 21:
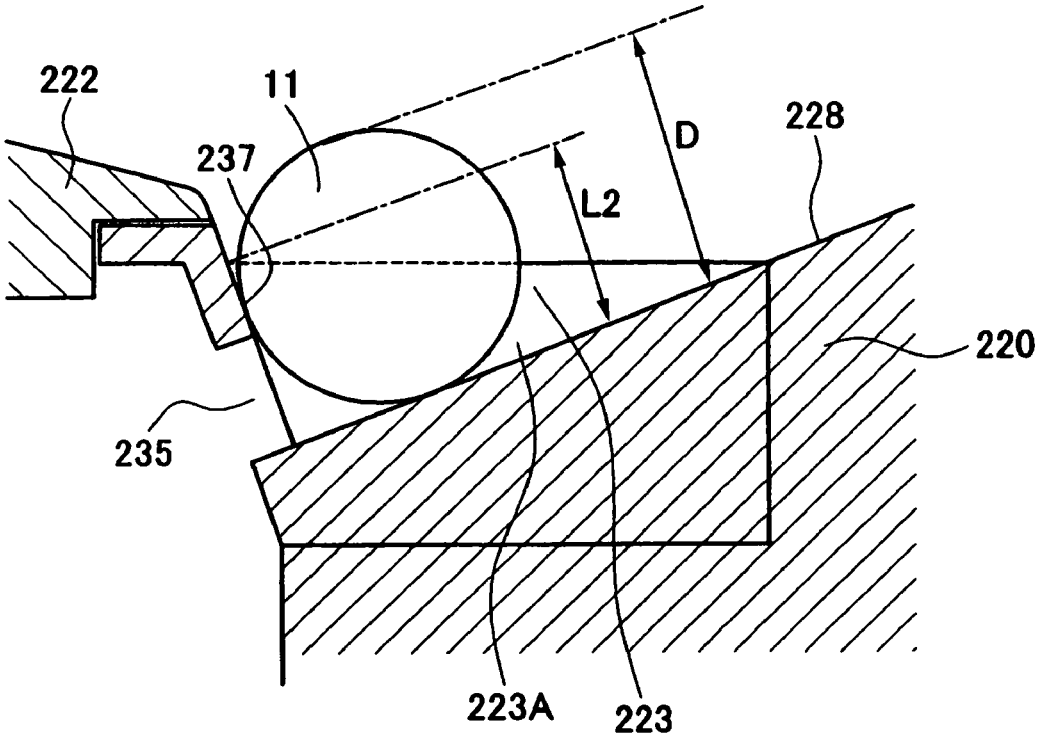
FIG. 21 is an enlarged cross-sectional view of a ball receiving part in a roulette device according to the second embodiment.
Figure 22:
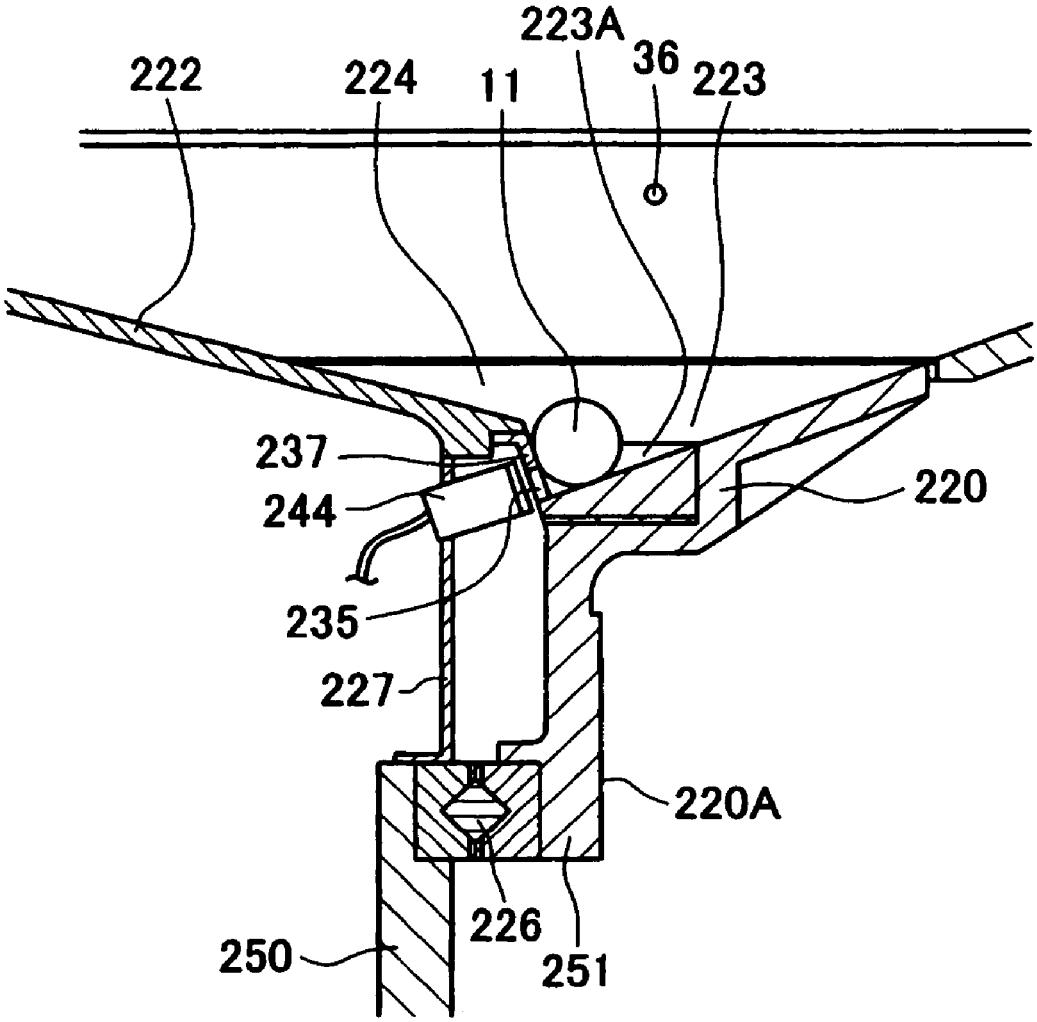
FIG. 22 is a cross-sectional view of the roulette device taken along the line C-C of FIG. 19.
Figure 23:
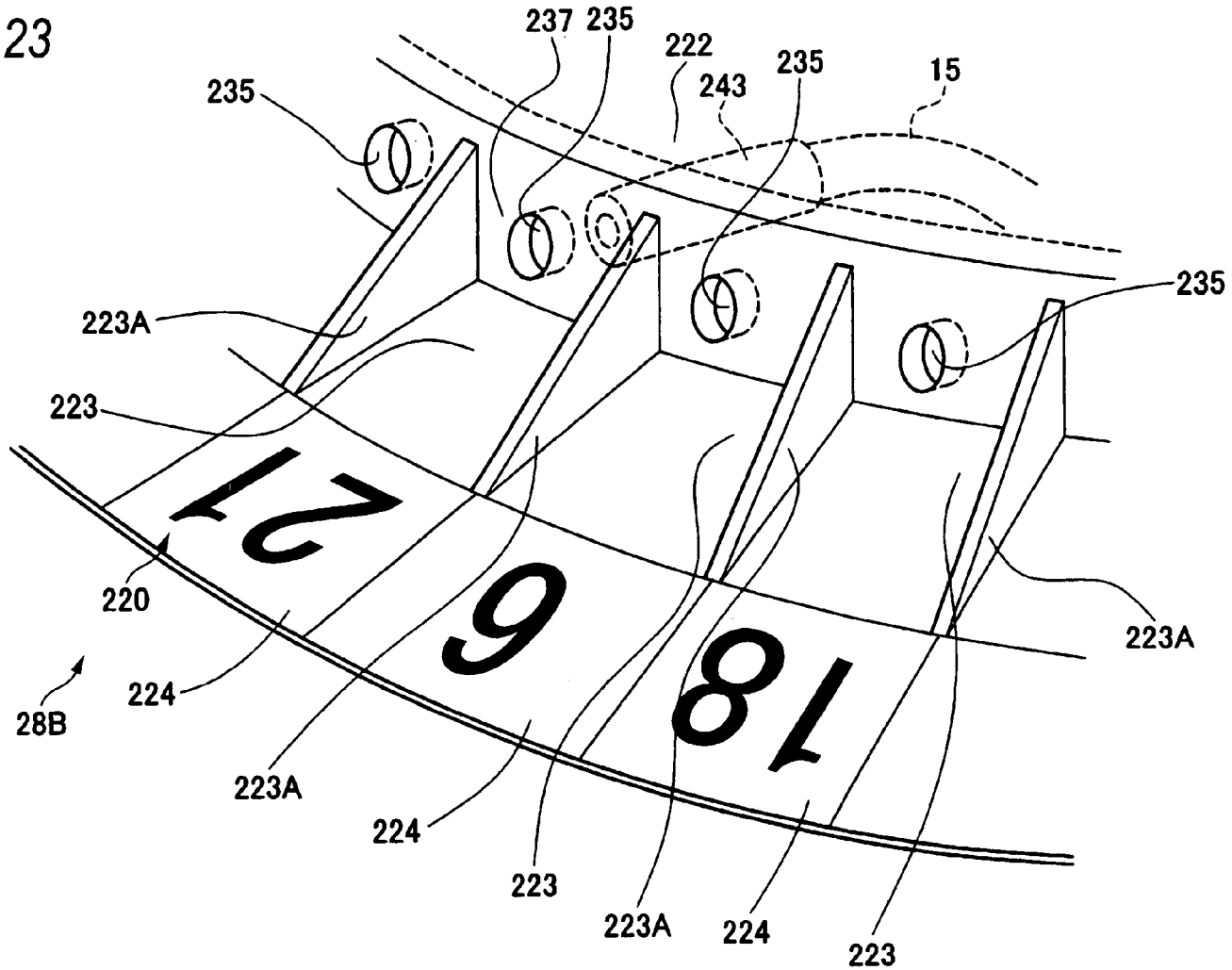
FIG. 23 is an enlarged perspective view of a bank passage in a roulette device according to the second embodiment.

First, a construction of the roulette device 202 according to the second embodiment will now be described with reference to FIGS. 18 to 23. FIG. 18 is a perspective view showing the roulette device according to the second embodiment. FIG. 19 is a plan view showing the roulette device according to the second embodiment. FIG. 20 is a cross-sectional view of the roulette device taken along the line B-B of FIG. 19. FIG. 21 is an enlarged view of a ball receiving part shown in FIG. 20. FIG. 22 is a cross-sectional view of the roulette device taken along the line C-C of FIG. 19. FIG. 23 is an enlarged perspective view of a ball receiving part of a roulette device according to the second embodiment.

As shown in FIG. 18, the roulette device 202 according to the second embodiment includes the roulette plate 212 having a rolling area in which a ball 11 rolls during the game, the support 13 for supporting the roulette plate 212 from inside of the roulette gaming machine 201, the compressor 14 receiving ambient air and compressing it at a predetermined pressure, the air tubes 15, 16 sending the air compressed by the compressor 14, and the first and second valves 17 and 18 each provided in the middle of each air tube 15, 16 to adjust the air pressure.

The roulette plate 212 includes the rim 221 fixed to the support 13, the central fixing part 222 fixedly supported on inside of the rim 221, and the ring-shaped rotating part 220 provided in a vicinity of the central fixing part 222. The rotating part 220 has a plurality of concave ball receiving parts 223 (thirty-eight ball receiving parts in case of the second embodiment) along a circumferential direction on its upper surface. The ball receiving parts 223 are partitioned by triangular-shaped partition walls 223A (see FIG. 23). On an upper side of the rotating part 220 on an outside of each ball receiving part 223, number-indication parts 224 with numerals '0', '00', and '1' to '36' are provided to correspond to the respective ball receiving part 223. The rotating part 220 is rotatably supported via the cross ball bearing 226 in respect to the central fixing part 222 (see FIG. 24). In addition, the rotating part 220 rotates at a predetermined speed (e.g., 2Π [rad/s]) in a predetermined direction (e.g., in a clockwise direction) in respect to the rim 221 by means of a drive motor (see FIG. 20) provided inside the roulette device 2 during from when the ball 11 starts to roll until a predetermined time interval elapses after the ball 11 is received in the ball receiving part 23. When the ball 11 is discharged after termination of the bet time, the rotating part 20 is rotated such that the ball receiving part 223 currently receiving the ball 11 is located in front of the fixed discharging hole 243 fixed to the central fixing part 222. Meanwhile, when the ball receiving part 223 receiving the ball 11 is detected after the ball 11 stops rolling, the rotating part 220 is rotated such that it passes through the front side of the ball detection sensor fixed to the central fixing part 222. The rotating operation of the rotating part 220 will be described below in detail.

The rolling area in which the ball 11 actually rolls on the roulette plate 212 is formed to have an inclined plane 228 which is inclined at a predetermined angle (15° in case of the second embodiment) and made up of a first inclined plane 228A formed by the ball receiving part 223 and the number-indication part 224 located on the rotating part 220 and a second inclined plane 228B formed on an inner periphery of the rim 221. The inclined plane 228 is inclined in an ascending direction from the center of the roulette plate 212 to the outer periphery. The ball receiving part 223 and the bank passage 229 are continuously formed via the inclined plane 228.

Also, a bank passage 229 is formed on an outer periphery of the rim 221. The bank passage 229 is responsible for guiding the ball 11 against the centrifugal force of the ball 11 rolling on the roulette plate 212 to allow the ball 11 to roll along a circumferential orbit. Also, the bank passage 229 is formed in respect to the roulette plate 212 by means of a guide wall 230 provided in a vertical direction. In addition, a wall portion 231 is formed to be continuously connected with the bank passage 229 on an upper side of the outer periphery. The wall portion 231 acts to pressurize the ball 11 rotating along the bank passage 229 so that the ball 11 cannot get out of the roulette plate 212.

The ball 11 is accelerated by air discharged from the following fixed discharge hole 243 and second discharge holes 36 and starts to rotate along the bank passage 229. Meanwhile, if the air is not discharged from the second discharge hole 36, the ball 11 is decelerated and rolls down the inclined plane 28 toward inside of the roulette plate 212, reaching the rotating part 220 which is rotating.

The ball 11 reaching the rotating part 220 passes through the number-indication part 224 of the rotating part 220 and is received in any one of the ball receiving parts 223. A numeral recorded in the number-indication part 224 corresponding to the ball receiving part 223 which has received the ball 11 is a winning number.

As shown in FIG. 21, a depth L2 of the ball receiving part 223 in respect to the inclined plane 228 is formed to be shorter than a diameter D of the ball 11.

As described above, the ball receiving part 223 is a space for receiving the ball 11, which is partitioned by the partition walls 223A into 38 sub-parts in a circumferential direction. As shown in FIG. 21, since the depth L2 of the ball receiving part 223 is formed to be shorter than the diameter D of the ball 11, the ball 11 is not completely covered by the ball receiving part 223 and the ball received in the ball receiving part 223 can be easily found by game players when the ball 11 is received in the ball receiving part 223, resulting in increased entertainment.

In addition, since the ball receiving part 223 and the bank passage 229 are continuously formed by an inclined plane 228 inclined in an ascending direction from the ball receiving part 223 to the bank passage 229 at a predetermined angle, the game player can easily locate the ball received in the ball receiving part 223.

The fixed discharge hole 243 and various sensors such as a ball detection sensor 244 provided on the central fixing part 222 of the roulette plate 212 will be described with reference to FIGS. 20, 22, and 23. Unlike the roulette device 2 according to the first embodiment, the roulette device 202 according to the second embodiment includes the fixed discharge hole 243 for discharging air compressed by the compressor 14 to the central fixing unit 222 which is not rotated during the game, and the ball detection sensor 244 for detecting the ball receiving part 223 receiving the ball 11.

As shown in FIGS. 19 and 20, the fixed discharge hole 243 is fixedly supported by the fixing plate 227 on an outer periphery opposing to the rotating part 220 of the central fixing unit 222. The fixed discharge hole 243 carries air compressed at a predetermined pressure (e.g., 1 MPa) by the compressor 14 (see FIG. 18) provided below the roulette device 202 to the roulette plate 212 via the air tube 15.

Meanwhile, a circular air passing hole 235 is formed on an inner wall 237 to correspond to each ball receiving part 223, which is formed by the inside wall 237 and the partition walls 223A. According to the second embodiment, thirty-eight ball receiving parts 223 are formed to correspond to the numerals '0', '00', and '1' to '36', and thus thirty-eight first discharge holes 35 are formed. Also, as shown in FIG. 23, in the ball receiving part 223 (numeral 21 of a ball receiving part in FIG. 23) in front of the fixed discharge hole 243, the air discharged from the fixed discharge hole 243 is discharged via the air passing hole 235 and the ball receiving part 223 to the bank passage 229 provided on an outer periphery of the roulette plate 212. The ball 11 received in the ball receiving part 223 starts to roll against the inclined plane 228 to a direction of the bank passage 229 by air pressure of the discharged air.

As shown in FIGS. 19 and 22, the ball detection sensor 244 is fixedly supported by the fixing plate 227 on an outer periphery opposing to the rotating part 220 of the central fixing unit 222. The ball detection sensor 244 is a reflective optical sensor and consists of a light-emitting unit emitting infrared light and a light-receiving unit receiving the light. When there is any object within a predetermined distance, the ball detection sensor 244 can detect the presence and location of the object. Accordingly, the ball detection sensor 244 can detect, through the air passing hole 235, the ball 11 received in a predetermined position (e.g., at a distance of 3 cm) of the ball receiving part 223 located in front of the ball detection sensor 244. The ball detection sensor 244 may be a transmissive optical sensor. In this case, the light-receiving unit is provided on the central fixing part 222, and the light-emitting unit is provided on a position of the bank passage 229 opposing to the light-receiving unit. When the ball 11 is present in the ball receiving part 223 located between the light-emitting unit and the light-receiving unit, the ball detection sensor 244 can detect the ball 11.

Also, in addition to the ball detection sensor 244, an origin sensor 257 and a rotation sensor 258 are provided in the central fixing part 222. The origin sensor 257 and the rotation sensor 258 are fixedly supported by the fixing plate 227 on an outer periphery opposing to the rotating part 220, like the ball detection sensor 244 and the fixed discharge hole 243.

The origin sensor 257 is a sensor detecting where the ball receiving part 223 located in front of the origin sensor 257 is located in respect to the origin (reference point). Also, the rotation sensor 258 is a sensor detecting whether or not the rotating part 220 rotates.

In more detail, while the rotation sensor 258 is detecting that the rotating part 220 is rotating, the origin sensor 257 detects unevenness of an uneven identification plate (not shown) attached to the other side (a side opposing to the origin sensor 257) of the inner wall 237 of the ball receiving part 223 so that the origin sensor 257 can detect where the ball receiving part 223 currently located in front of the origin sensor 257 is located relative to the ball receiving part. 223 located corresponding to the origin '00'. For example, in FIG. 19, the ball receiving part 223 located in front of the origin sensor 257 (a ball receiving part corresponding to the numeral '35') is detected to be a ball receiving part 223 located at the sixteenth location in a right direction from the ball receiving part 223 located corresponding to '00'.

Accordingly, the origin sensor 257 can detect where the ball receiving part 223 located in front of the origin sensor 257 is located relative to the ball receiving part 223 located corresponding to '00', at a timing when the ball 11 is detected by the ball detection sensor 244. Based on the detected result, it can be calculated where the ball receiving part 223 receiving the ball 11 detected by the ball detection sensor 244 is located relative to the ball receiving part 223 located corresponding to '00'. Accordingly, a number ('0', '00', '1' to '36') corresponding to the ball receiving part 223 receiving the detected ball 11, i.e., a winning number, can be determined (step S118 in FIG. 27). The origin (reference point) may be another ball receiving part 223 rather than the ball receiving part 223 corresponding to '00'.

When the ball 11 is discharged at the start of the game, it can be determined whether or not the ball receiving part 223 receiving the ball 11 is located in front of the fixed discharge hole 243 based on the winning number of the previous game and a position of the ball receiving part 223 located in front of the origin sensor 257 relative to the ball receiving part 223 located corresponding to '00'. Accordingly, the drive motor 234 can be controlled based on the determined result so that the ball receiving part 223 receiving the ball 11 can be located in front of the fixed discharge hole 243 to discharge the ball 11 (steps S106 to S108 in FIG. 27).

As described above, in the roulette gaming machine according to the second embodiment, the ball 11 is received in the ball receiving part 223 and the rotating part 220 is then rotated by at least a ⅓ turn rotation, whereby any one ball detection sensor 244 passes by all the ball receiving parts 223. The result detected by the origin sensor 257 at the timing the ball 11 is detected is transmitted to the following main control CPU 80 (see FIG. 25). The main control CPU 80 determines a winning number based on the result.

The ball 11 can be discharged from the ball receiving part 223 by controlling the following drive motor 234 so that the fixed discharge hole 243 can be located in front of the ball receiving part 223 receiving the winning number of the previous game, and discharging air from the fixed discharge hole 243. Accordingly, a process of rolling the ball 11 and receiving the ball 11 in the ball receiving par 23 can be repeatedly performed without the need to take back the ball 11 from the roulette plate 212 by applying air pressure of the air discharged from the fixed discharge hole 243 and the second discharge hole 36 to the ball 11, thus not requiring a complex apparatus such as a unit for collecting the ball 11 or a unit for discharging the ball 11 and facilitating operation and maintenance of the device and reducing the operation and maintenance costs. The second discharge hole 36 and the rotating air pipe 39 are the same as those of the first embodiment and a detailed description thereof will thus be omitted herein.

Figure 24:
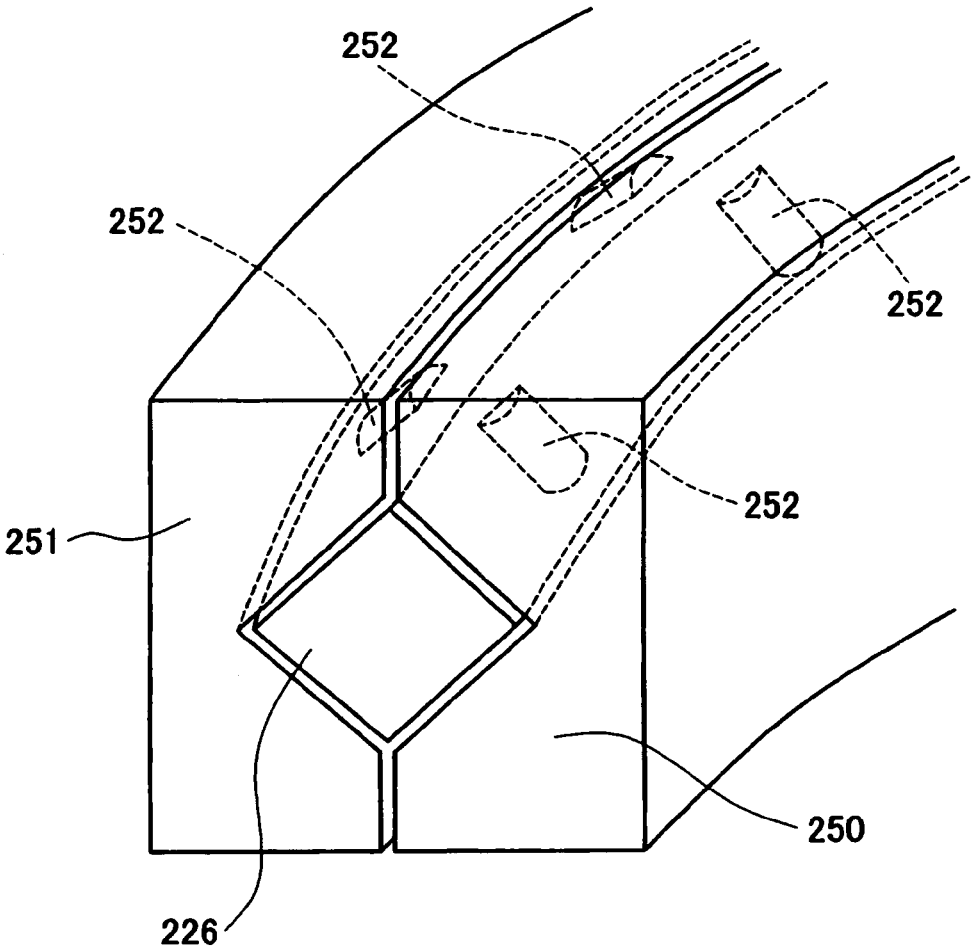
FIG. 24 is a view showing a cross ball bearing which rotatably supports a rotating part in respect to a central fixing part.

A rotating system of the rotating part 220 in respect to the central fixing part 222 of the roulette plate 212 will now be described with reference to FIGS. 20 and 24. FIG. 24 is a view showing the cross ball bearing 226 which rotatably supports the rotating part 220 in respect to the central fixing part 222.

As shown in FIG. 20, the drive motor 234 is fixed to a bottom plate 221A of the rim 221. The drive motor 234 is a stepping motor which rotates by a predetermined step unit without feedback by applying a pulse signal. Accordingly, the rotating angle and rotating speed of the drive motor 234 are determined according to the frequency and period of the pulse signal applied to the drive motor 234. When the pulse signal is stopped, the drive motor 234 is stopped while maintaining the rotating angle.

The drive motor 234 is equipped with a drive roller 247 via a drive shaft 246. The drive roller 247 contacts to a side 220A of the rotating part 220. Accordingly, when the drive motor 234 is driven, the drive roller 247 is also rotated and the rotating part 220 is also rotated in respect to the central fixing part 222 by friction with the drive roller 247. The drive roller 247 is located in a roller case formed in a 'U' shape. The roller case 248 is pressurized by a certain force toward the side 220A by a pressurizing member 249 located on an outer periphery of the drive roller 247. Accordingly, since the drive roller 247 and the side 220A of the rotating part 220 contact with each other by a predetermined pressure, an excessive load will not be imposed on the drive roller 247 and the drive roller 247 will not run idle.

As shown in FIGS. 20 and 24, a fixing-side inner wall 250 of the central fixing part 222 and a rotating-side inner wall 251 of the-rotating part 220 opposing to the fixing-side inner wall 250 are connected to each other via the cross ball bearing 226.

The cross ball bearing 226 is a circular ring-shaped member having a rectangular-shaped section, and has thirty to forty bearings 252 on its four surfaces. Accordingly, the rotating-side inner wall 251 can be freely moved in respect to the fixing-side inner wall 250 fixed to the rim 221. The rotating part 220 is rotatably supported in respect to the central fixing part 222.

Accordingly, based on the rotating direction and rotating angle of the drive motor 234 driven by the pulse signal, the rotating part 220 can be rotated by a predetermined angle in respect to the central fixing part 222. Accordingly, the ball receiving part 223 located in front of the fixed discharge hole 243 and the ball detection sensor 244 is changed to a certain ball receiving part 223. Accordingly, it is possible to detect the ball receiving part 223 receiving the ball 11 and discharge the received ball 11. Also, the drive motor 234 is connected via a motor drive circuit 255 to the main control CPU 80 (see FIG. 25) and is driven based on a program stored in ROM and the like as described below.

Figure 25:
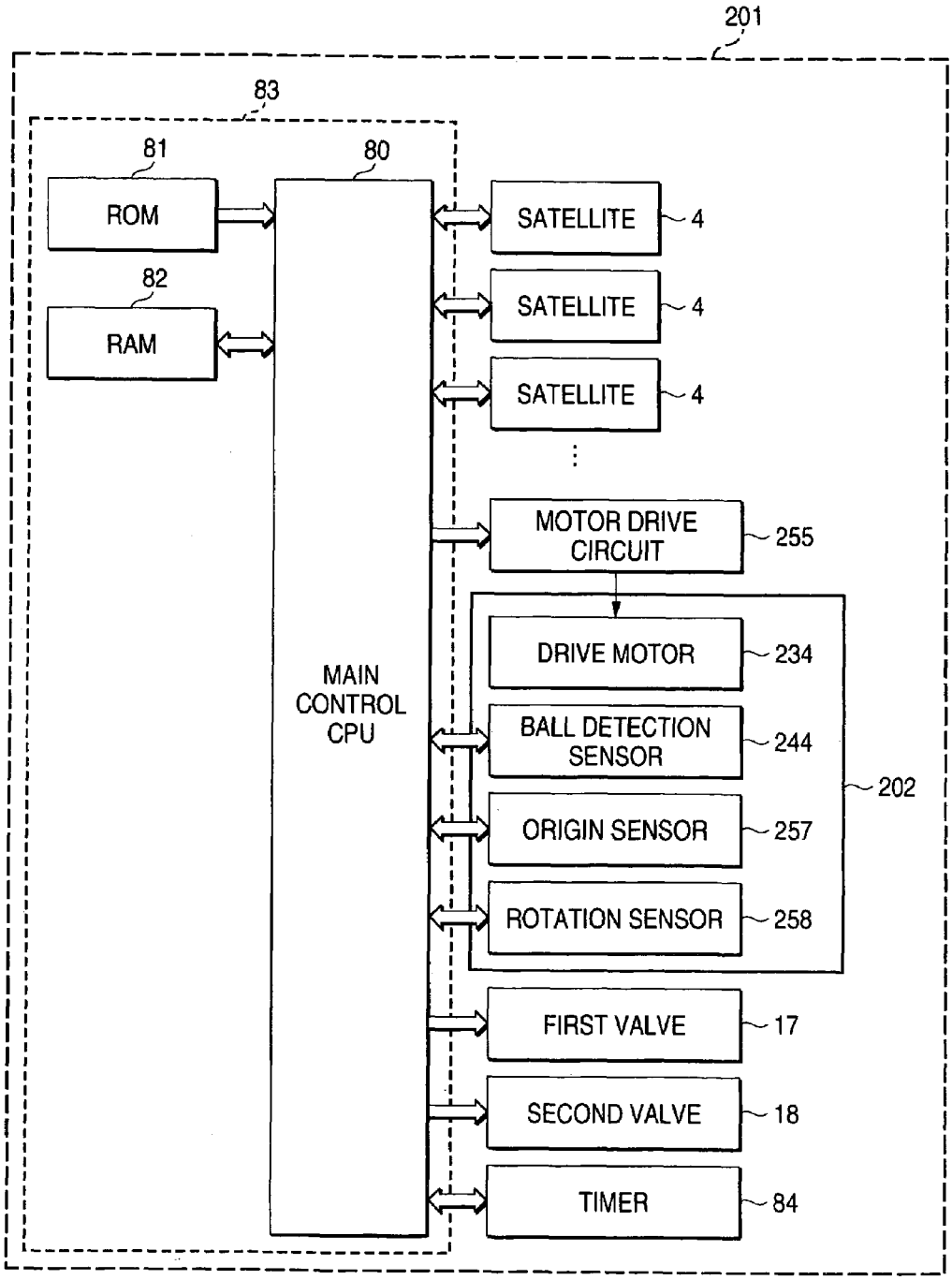
FIG. 25 is a block diagram showing a control system of a roulette gaming machine according to the second embodiment.

A control system of the roulette gaming machine 201 according to the second embodiment will now be described with reference to FIG. 25. FIG. 25 is a block diagram showing a control system of a roulette gaming machine according to the second embodiment.

As shown in FIG. 25, the roulette gaming machine 201 includes a main controller 83 having the main control CPU 80, ROM 81, and RAM 82, a roulette device 202 connected to the main controller 83, ten satellites 4 (see FIG. 1), and the first and second valves 17 and 18. The control system of the satellite 4 is the same as that of the first embodiment and a detailed description thereof will thus be omitted herein.

The main control CPU 80 performs various processes based on input signals supplied from each satellite 4 and data or programs stored in ROM 81 and RAM 82. The main control CPU 80 transmits command signals to the satellite 4 based on the result, thereby controlling each satellite and performing the game. Also, the main control CPU 80 drives the drive motor 234, controls the ball detection sensor 244 (see FIG. 22) provided in the roulette device 202, and determines a winning number of the ball receiving part 23 receiving the ball 11. It is determined whether or not the bet chips are determined the winning based on the obtained winning number and bet information transmitted from the satellite 4, and the number of credits paid in each satellite 4 is calculated.

The ROM 81 consists of, for example, semiconductor memory and the like. The ROM 81 stores programs for implementing basic functions of the roulette gaming machine 201, programs for controlling various devices in the roulette device 202, the first valve 17 and the second valve 18, programs for controlling the drive motor 234, odds (the number of credits-to-be-paid per chip) for a typical roulette game using the BET screen 51, and program for controlling each satellites 4.

Meanwhile, the RAM 82 temporarily stores bet information of chips supplied from each satellite 4, a winning number of the roulette device 2 determined by the ball detection sensor 244, and data on results of processes performed by the main control CPU 80.

Also, the main control CPU 80 is connected to the first and second valves 17 and 18 for adjusting air pressure in the air tubes 15, 16. By opening the first valve 17, the air compressed by the compressor 14 (see FIG. 18) is discharged from the fixed discharge hole 243 provided in the ball receiving part 223. Also, by opening the second valve 18, the air compressed by the compressor 14 is discharged from the second discharge hole 36 provided in the bank passage 229.

When the bet time of the game player is terminated in each satellite 4, i.e., when the BET timer graph 59 of the BET screen 51 reaches the rightmost point, the ball receiving part 223 of the winning number of the previous game, i.e., the ball receiving part 223 receiving the ball 11, is located in front of the fixed discharge hole 243 by driving the drive motor 234. In addition, the first valve 17 is opened during a predetermined time interval (2 seconds in case of the second embodiment). Accordingly, the ball 11 received in the ball receiving part 223 at the termination time of the previous game rolls toward the bank passage 29 by application of air pressure.

Subsequently, the second valve 18 is opened to form air flow flowing along the bank passage 229 of the roulette plate 212. The ball 11 which rolls on the bank passage by the air pressure applied from the fixed discharge hole 243 rotates on the bank passage 229 in a clockwise direction with the air flow.

Next, when the second valve 18 is closed after a predetermined time interval (15 seconds in case of the second embodiment), the air flow discharged from the second discharge hole 36 is stopped and the ball 11 is decelerated slowly, so that the ball 11 rolls down along the inclined plane 228 and is received in the ball receiving part 223.

Also, the main control CPU 80 is connected to the ball detection sensor 244, the origin sensor 257, and the rotation sensor 258, which are provided in the roulette device 2. As described above, three ball detection sensors 244 are provided on the central fixing unit 222. When the ball 11 is received in the ball receiving part 223 located in front of the ball detection sensor 244, the ball detection sensor 244 can detect a number corresponding to the ball receiving part. The origin sensor 257 can detect a position of the ball receiving part 223 located in front of the origin sensor 257 relative to the origin (a ball receiving part located corresponding to '00'). The rotation sensor 258 can detect whether or not the rotating part 220 rotates. The results detected by each sensor are transmitted to the main control CPU 80, whereby the main control CPU 80 determines a winning number.

Also, the main control CPU 80 is connected through the motor drive circuit 255 to the drive motor 234 which rotates the rotating part 220. When a motor drive signal is outputted from the main control CPU 80 to the motor drive circuit 255, a pulse signal is applied from the motor drive circuit 255 to the drive motor 234, which rotates in a predetermined direction by the predetermined number of turns based on the pulse signal. Accordingly, the rotating part 220 rotates in a predetermined direction (e.g., in a clockwise direction) by a predetermined angle (e.g., 45°) in respect to the central fixing unit 222 and the rim 221, so that the ball receiving part 223 can be provided in front of the fixed discharge hole 243.

Also, the main control CPU 80 is connected to a timer 84 for measuring time. Time information of the timer 84 is transmitted to the main control CPU 80. The main control CPU 80 opens/closes the first and second valves 17 and 18 based on the time information of the timer 84 as described below.

Figure 26:
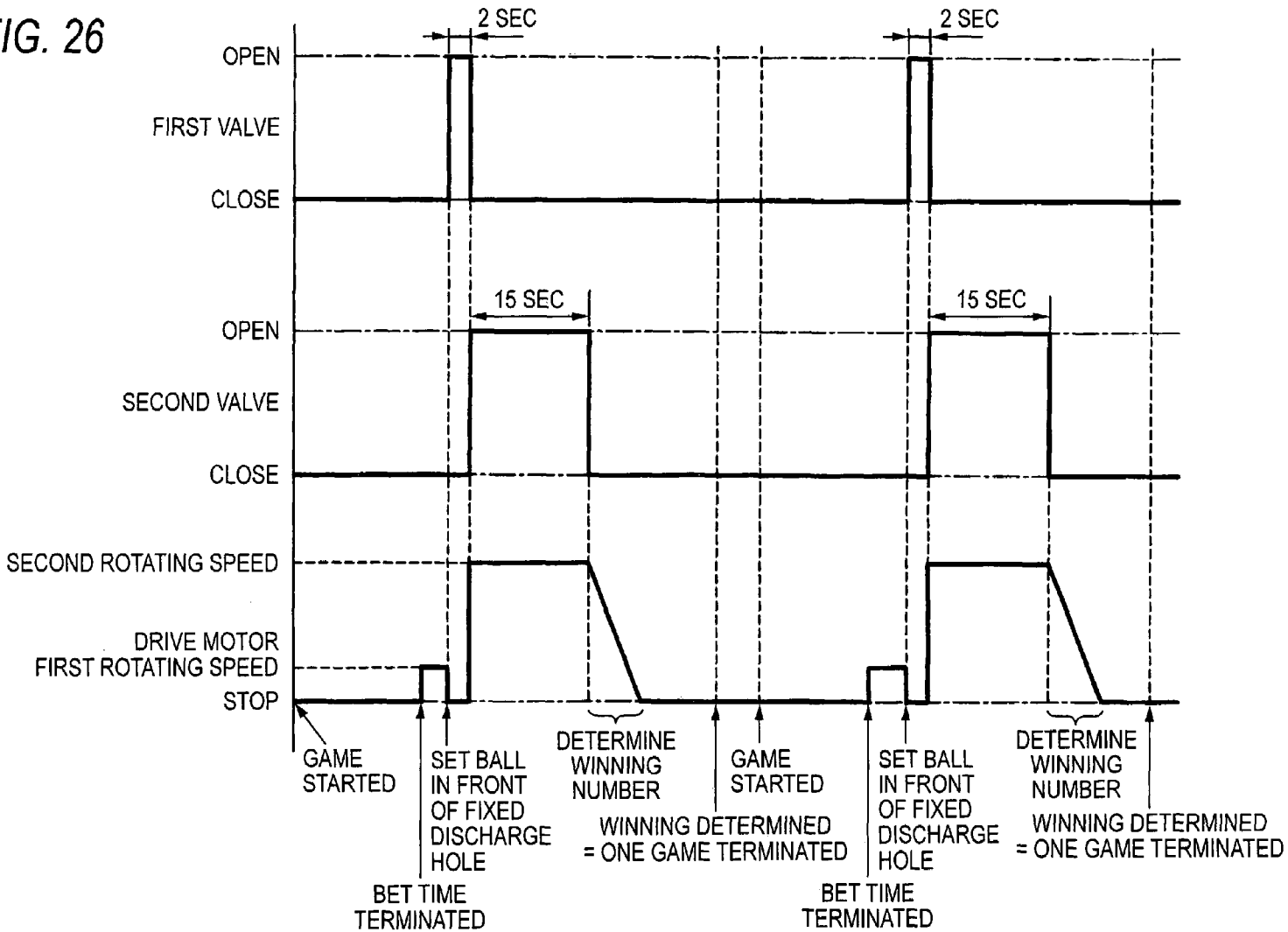
FIG. 26 is an explanatory diagram showing a timing diagram of first and second valves and control of a drive motor.

Next, open/close timing of the first and second valves 17 and 18 stored in the ROM 81 and control of the drive motor will now be described with reference to FIG. 26. FIG. 26 is an explanatory view showing the open/close timing of the first and second valves and the control of the drive motor 234.

As shown in FIG. 26, when the game starts, the bet time is initiated. During the bet time, a game player can bet chips in each satellite 4. After the bet time is terminated (after the BET timer graph 59 of the BET screen 51 reaches the rightmost point), the location of the ball receiving part 223 receiving the ball 11 is determined based on the winning number of the previous game and the result detected by the origin sensor 257, the drive motor 234 is driven at a predetermined first rotating speed until the ball receiving part 223 is located in front of the fixing discharge part 243, and the rotating part 220 is rotated at a predetermined rotating speed (e.g., 0.2π [rad/s]). The main control CPU 80 opens the first valve 17 for a predetermined time interval (2 seconds in case of the second embodiment). Subsequently, the second valve 18 is opened to produce circular air flow flowing along the bank passage 229 of the roulette plate 212 (see FIG. 16). The ball 11 rolling toward the bank passage 229 by air pressure from the fixed discharge hole 243 rotates with the air flow along the bank passage 229 in a clockwise direction. At the same time, the drive motor 234 is driven at a predetermined second rotating speed, the rotating part 220 is rotated at a predetermined rotating speed (e.g., 0.2π [rad/s]).

Next, the main control CPU 80 closes the second valve 18 after a predetermined time interval (15 seconds in case of the second embodiment). Accordingly, the air flow discharged from the second discharge hole 36 is stopped and the ball 11 is decelerated slowly, so that the ball 11 rolls down along the inclined plane 228 and is finally received in the ball receiving part 223. After closing the second valve 18, the drive motor 234 is gradually decelerated so that the rotating part 220 is decelerated. A winning number is determined by the ball detection sensor 244, the origin sensor 257, and the rotating sensor 258. Also, medals are given according to the determined winning number. As a result, one game is terminated. When another game is restarted, the bet time of the satellite 4 is initiated. After the bet time is terminated, the main control CPU 80 opens the first valve 17. A roulette game process program according to the open/close timing of the first and second valves and the control of the drive motor 234 will be described below in detail with reference to the following flow chart (see FIG. 27).

Figure 27:
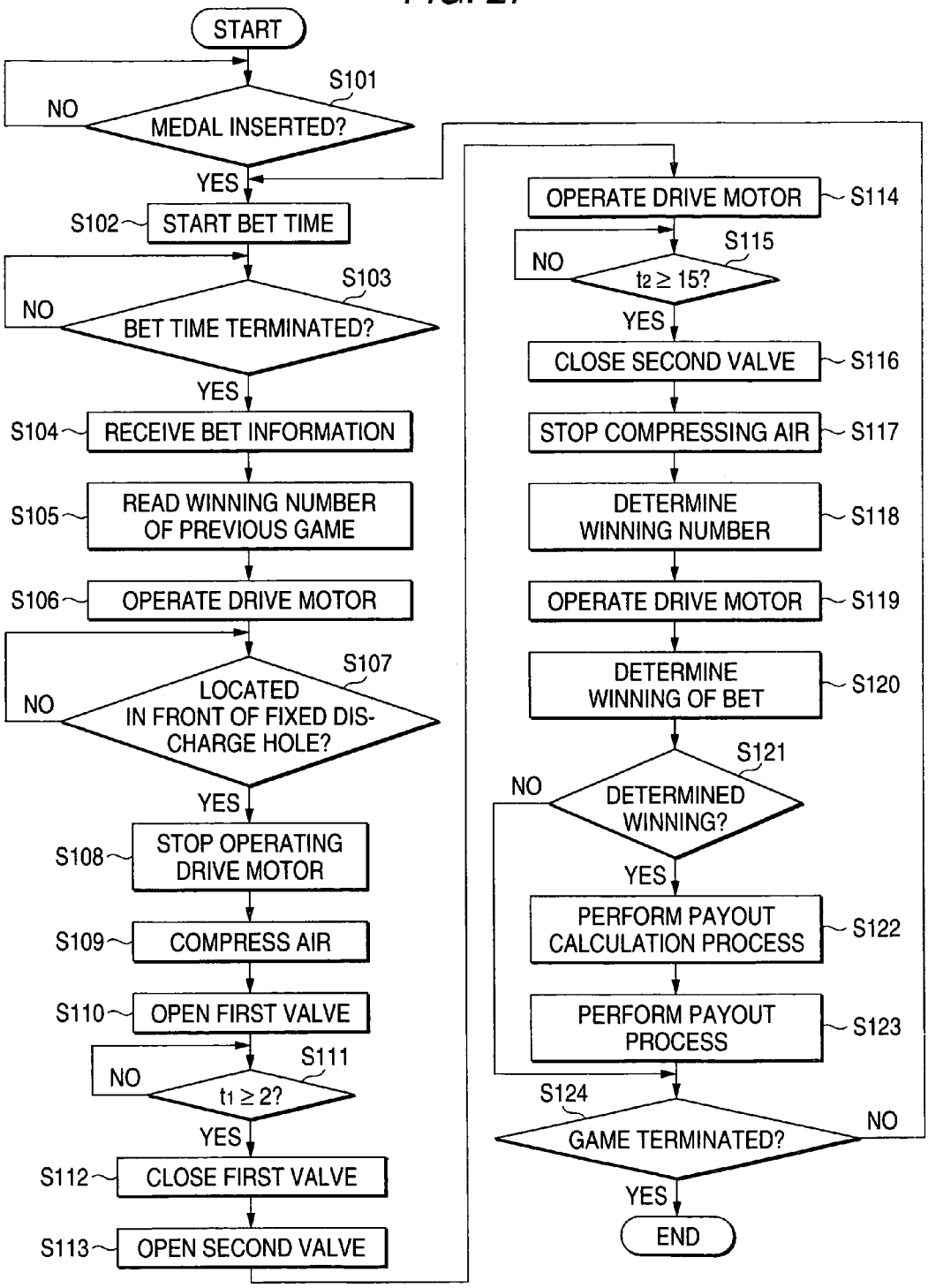
FIG. 27 is a flow chart of a typical roulette game process program according to the second embodiment.

A game process program in the roulette gaming machine 201 according to the second embodiment will now be described with reference to FIG. 27. FIG. 27 is a flow chart of a roulette game process program in the roulette gaming machine 201 according to the second embodiment. The programs shown in the flow chart of FIG. 27 are stored in ROM 81 and RAM 82, and are run by the main control CPU 80.

In step S101, the main control CPU 80 determines whether on not medals or coins are inserted by a game player. In the roulette gaming machine 1 according to the second embodiment, when medals or coins are inserted to the medal insertion slot 5 in any one of the satellites 4, the medal sensor 97 detects it and transmits it to the satellite control CPU 91. Next, a medal insertion signal is transmitted from the satellite 4 to the main controller 83. The main control CPU 80 determines whether or not medals or coins are inserted by a game player. When medals or coins are not inserted (S101: NO), it waits for the medals or coins to be inserted. Otherwise (S101: YES), it proceeds to step S102. When medals or coins are inserted, credit data on the amount of money corresponding to the number of inserted coins is recorded in the satellite controller 90.

The BET screen 51 shown in FIG. 8 is displayed on the image display device 7 of the satellite used by the game player so that the game player can bet chips. Meanwhile, other game players can join the game, and up to ten game players can enjoy the game in the roulette gaming machine 1 according to the second embodiment.

The bet time the game player can bet is initiated from when a first game player inserts medals or coins (step S102). If a current game is continued after the previous game, the bet time is initiated after termination of the previous game. During the bet time, a game player joining the game can operate the touch panel 48 to bet chips on a BET area related to his/her selected number (see FIG. 8). A detailed betting method using the BET screen 51 has been already described.

Next, it is determined whether or not the bet time is terminated in step S103. The bet time is indicated by the BET timer graph 59. The BET timer graph starts to extend to the right side from the start of the bet time (S102). When the graph extends to the rightmost point, the bet time for the current game is terminated.

Before the bet time is terminated (S103: NO), a game player is allowed to make a bet. If the bet time is terminated (S103: YES), a bet termination signal is outputted to the satellite controller 90 of the satellite 4 and an image indicating that the bet time is terminated is displayed on a liquid crystal display of the satellite 4 so that a game player is not permitted to make a bet on the touch panel 48. The bet information (specified BET areas and number of chips bet on the specified BET areas) of the game player in the satellites 4 is received (step S104) and stored in the bet information storage area 82A of the RAM 82.

Next, the main control CPU 80 draws lots through the roulette device 2 according to the game program. In more detail, the winning number ('1' to '36', '00', '00') of the previous game is read from the winning number storage area 82B of the ROM 82 (step S105). The drive motor 234 is driven at a predetermined first rotating speed, and the rotating part 220 is rotated in respect to the central fixing part 222 at a predetermined rotating speed (e.g., 0.2π [rad/s]) (step S106).

At this time, the rotation sensor 258 detects that the rotating part 220 rotates, and at the same time, the origin sensor 257 provided on the central fixing part 222 specifies a location of the winning number of the previous game obtained in step S105, i.e., the ball receiving part 223 receiving the ball 11 relative to the fixed discharge hole 243. In step S107, based on the specified location, it is determined whether or not the ball receiving part 223 receiving the ball is located in front of the fixed discharge hole 243 by the rotation of the rotating part 220.

As a result, if the ball receiving part 223 receiving the ball 11 is determined to be located in front of the fixed discharge hole 243 (S107: YES), the motor 234 is stopped (step S108). Meanwhile, if the ball receiving part 223 receiving the ball 11 is determined not to be located in front of the fixed discharge hole 243 (S107: NO), the motor 234 continues to be driven.

Figure 28:
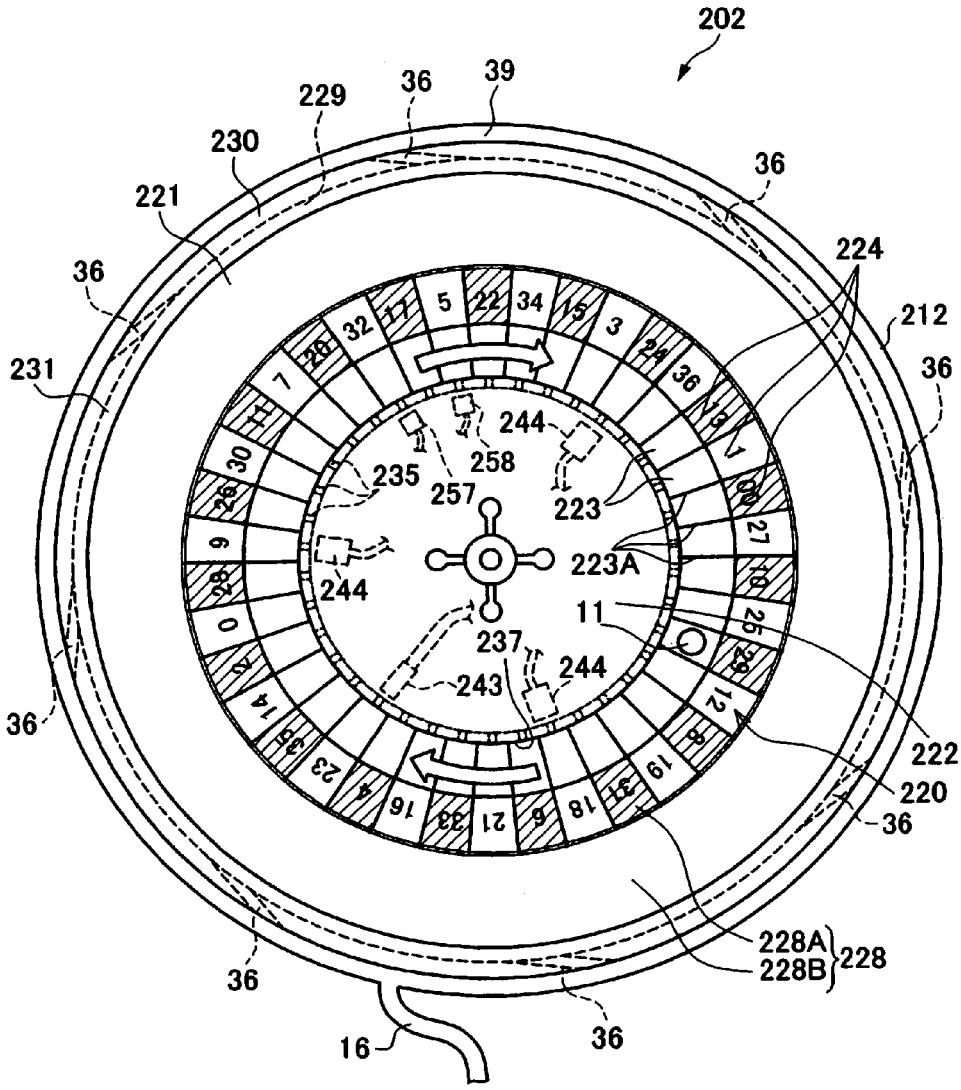
FIG. 28 is a view showing a rotating part rotating in a roulette device in steps S106 to S108.

FIG. 28 is a view showing the rotating part 220 of the roulette device 202 in steps S106 to S108. As shown in FIG. 28, if the ball receiving part 223 receiving the ball 11 (the ball receiving part corresponding to numeral '29' in FIG. 28) is a ball receiving part 223 which is located at the eleventh location in a left direction in respect to the fixed discharge hole 243, the rotating part 220 is rotated in a clockwise direction. When the rotating part 220 is rotated by a predetermined angle (corresponding to eleven ball receiving parts in a right direction in FIG. 28) and the ball receiving part 223 receiving the ball 11 is located in front of the fixed discharge hole 243, the rotating part 220 is stopped.

Figure 29:
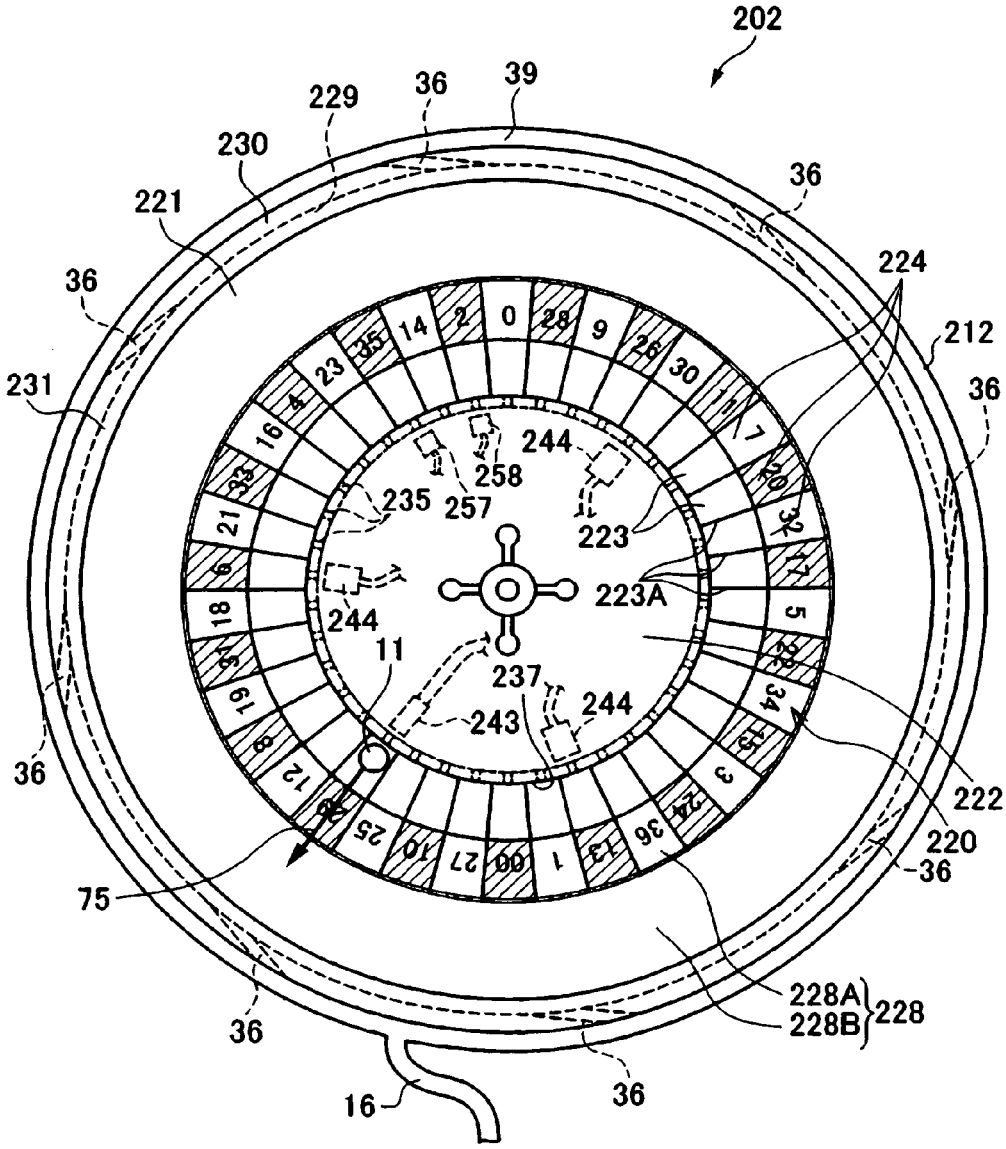
FIG. 29 is a view showing a ball rolling in a roulette device in step S110.
Figure 30:
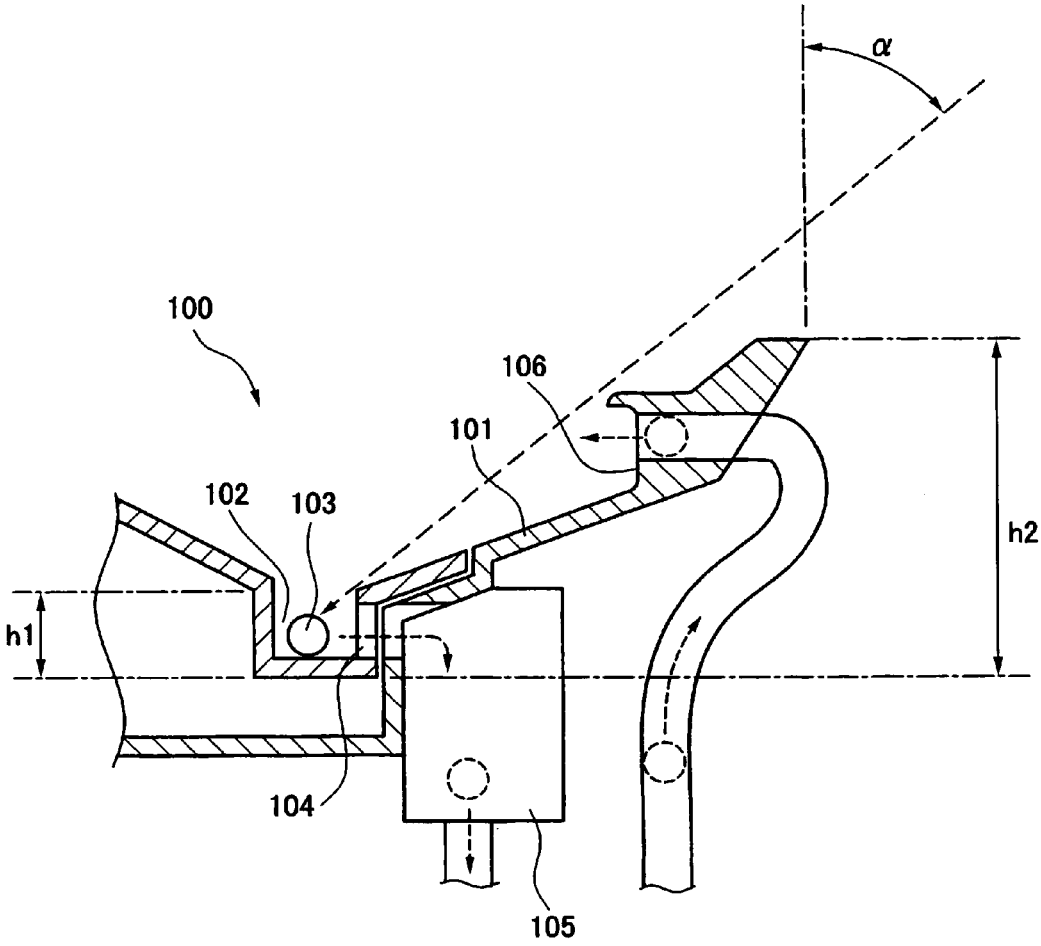
FIG. 30 is a view showing a roulette device used in a roulette gaming machine according to the prior art.
Figure 31:
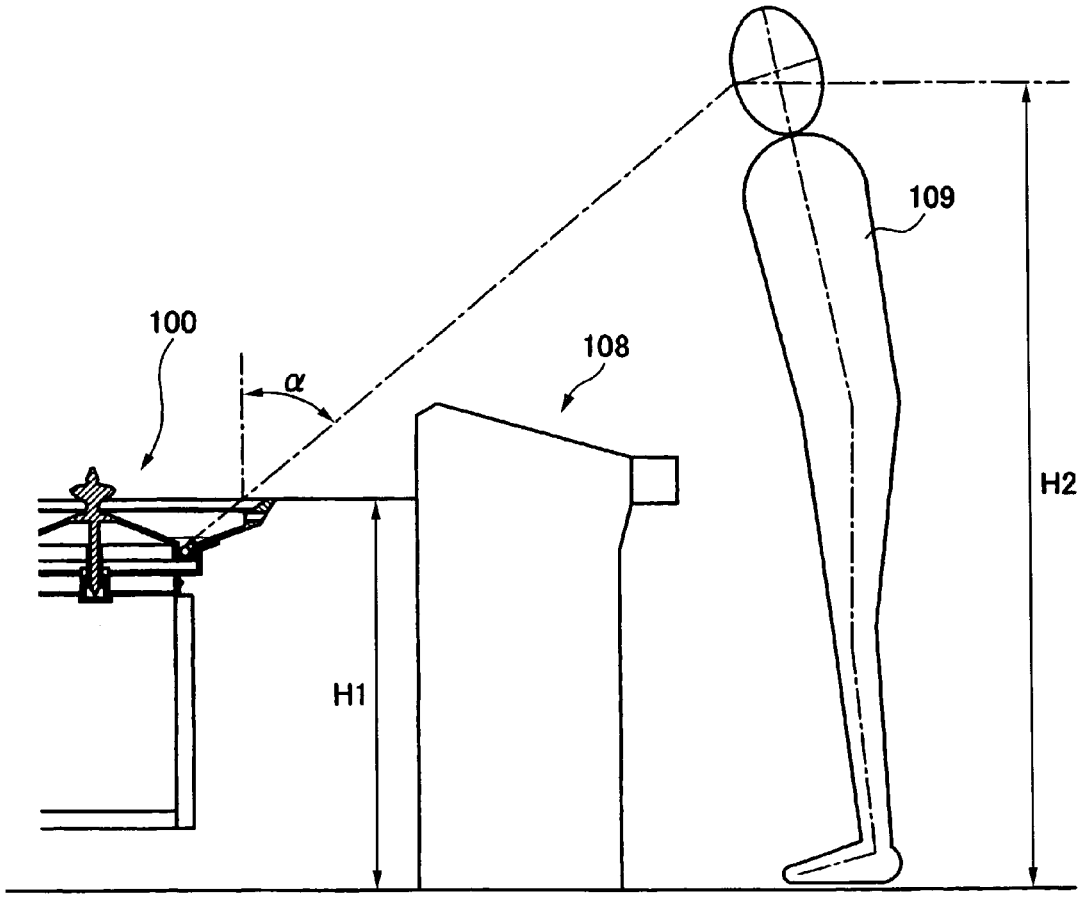
FIG. 31 is a view showing a roulette device used in a roulette gaming machine according to the prior art.

Subsequently, in step S109, the compressor is powered on to compress the air. Next, the first valve 17 is opened (step S110). The first valve 17 is provided on the air tube 15 which carries the air compressed by the compressor 14 to the fixed discharge hole 243 so that air pressure of the air passing through the air tube 15 can be controlled. When the first valve 17 is opened, the compressed air begins to be discharged from the fixed discharge hole 243. The air pressure is applied to a ball 11 received in any one of the ball receiving parts 223 so that the ball 11 rolls to the bank passage 229. FIG. 29 is a view showing the ball rolling in the roulette device in step S110.

As shown in FIG. 29, in step S110, when the first valve 17 is opened, the ball 11 received by the ball receiving part 223 rolls toward the bank passage 229 (in a direction of arrow 75) by air pressure from the fixed discharge hole 243 provided in the central fixing unit 222.

Next, in step S111, it is determined whether or not a predetermined time (2 seconds in case of the second embodiment) has elapsed after the first valve 17 is opened. The elapsed time is measured by a timer 84 connected to the main control CPU 80. If the measured value t1 is less than two seconds after the first valve 17 is opened (S111: NO), the first valve 17 is still opened.

Meanwhile, if the measured value t1 is two seconds or more after the first valve 17 is opened (S111: YES), it proceeds to step S112.

In step S112, the main control CPU 80 closes the first valve 17, and stops air-discharging from the fixed discharge hole 243. Subsequently, the second valve 18 is opened in step S113. The second valve 18 is provided in the air tube 16 carrying the air compressed by the compressor 14 to the second discharge hole 36, and controls air pressure of the air passing through the air tube 16. When the second valve 18 is opened, the compressed air starts to be discharged from the second discharge hole 36. Accordingly, air flow flowing along the bank passage 229 in a clockwise direction is produced, and the ball 11 rolling to the bank passage 229 in step S110 starts to rotate along a circular orbit with the applied air pressure, like the roulette gaming machine 1 according to the first embodiment (see FIG. 16).

In step S114, the drive motor 234 is driven at a predetermined second rotating speed, so that the rotating part 220 is rotated at a predetermined rotating speed (e.g., 2π [rad/s]) in respect to the central fixing unit 222 (S114). Also, the rotation sensor 258 detects that the rotating part 220 rotates, and at the same time, the origin sensor 257 provided on the central fixing part 222 specifies a location of the ball receiving part 223 located in front of the origin sensor relative to the origin (a ball receiving part located corresponding to '00').

Also, in step S115, it is determined whether or not a predetermined time (15 seconds in case of the second embodiment) has elapsed after the second valve 18 is opened. The elapsed time is measured by a timer 84 connected to the main control CPU 80. If the measured value t2 is less than fifteen seconds after the second valve 18 is opened (S115: NO), the second valve 18 is still opened. Meanwhile, if the measured value t2 is fifteen seconds or more after the second valve 18 is opened (S115: YES), it proceeds to step S116.

In step S116, the main control CPU 80 closes the second valve 18 to stop air-discharging from the second discharge hole 36. In step S117, the compressor 14 is powered off to stop compressing the air.

Since the air is not discharged from the second discharge hole 36, the ball 11 rolling along the bank passage 229 is gradually decelerated and loses the centrifugal force. The ball 11 rolls down the inclined plane 228 toward the center of the roulette plate 212 and finally reaches the rotating part 220.

Subsequently, in step S118, the drive motor 234 is gradually decelerated and the ball 11 received in the ball receiving part 223 is detected by the ball detection sensor 244. From the result detected by the origin sensor 257 at the timing when the ball 11 is detected by the ball detection sensor 244, a numeral ('0', '00', '1' to '36') corresponding to the ball receiving part 223 in which the ball is detected, i.e., a winning number is determined (step S118).

Also, the main control CPU 80 stops driving the drive motor 234 (S119), and determines whether or not the chips bet in each satellite 4 has been determined the winning based on the bet information of each satellite 4 received in step S104 and the winning number determined in step S118 (step S120).

It is determined based on the result determined in step S120 whether or not the chips bet in at least one satellite 4 has been determined the winning (step S121). If the chip has been determined the winning (S121: YES), the main control CPU 80 performs a payout calculation process (S122). In the payout calculation process, the won chips are recognized in each satellite 4, and a total sum of the payout of the credits given to each satellite 4 is calculated using the odds (number of credits-to-be-paid per chip) for the BET area stored in the payout credit storage area 81A of the ROM 81. Subsequently, it proceeds to step S123.

Meanwhile, if it is determined that there are no won chips in each satellite 4 (S121: NO), it proceeds to step S124.

In step S123, a credit payout process is performed based on the payout calculation process in step S122. When the credit is paid to the satellite 4, credit data corresponding to the payout amount is output from the main controller 83 to the satellite controller 90 of the won satellite 4. The credit data is added to the RAM 93 of corresponding satellite 4.

In step S124, it is determined whether or not a game continues to be played in at least one of the satellites 4. A game player usually presses the CASHOUT button 46 when terminating the game. When the CASHOUT button 46 is pressed, medals (normally, one medal per credit) corresponding to credits which are acquired and possessed by a current game player are refunded through the medal payout opening 8 via the hopper 94.

When a game continues to be played in any one of the satellites 4 (S124: NO), it returns to step S102 so that the bet time is initiated again to perform the next game.

Meanwhile, when the game is terminated in all the satellites 4 (S124: YES), a corresponding roulette game process is terminated.

As described above, in the roulette gaming machine 1 according to the second embodiment, the fixed discharge hole 243 discharging the air compressed by the compressor 14 and various sensors for determining a winning number, such as the ball detection sensor 244, are provided on the central fixing part 222 fixedly supported in the central portion of the roulette plate 212 of the roulette device 2. The rotating part 220 is rotated so that the ball receiving part 223 receiving the ball 11 is located in front of the fixed discharge hole 243 (steps S106 to S108). The ball 11 received in the ball receiving part 223 rolls toward the bank passage 29 by air pressure of the air discharged from the fixed discharge hole 243 (S110). At the same time, the second discharge hole 36 which discharges air compressed by the compressor 14 to a circumferential direction of the bank passage 29 is provided to rotate the ball 11, which rolls to the bank passage 29, in a circumferential direction along the bank passage 29 by air pressure of the air discharged from the second discharge hole 36. Accordingly, a process of rolling the ball 11 on the roulette plate 212 and receiving the ball 11 in the ball receiving par 223 can be repeatedly performed without the need to take back the ball 11 from the roulette plate 212, thus not requiring a complex apparatus such as a unit for collecting the ball 11 or a unit for discharging the ball 11 and facilitating operation and maintenance of the device and reducing the operation and maintenance costs. In addition, since the depths of the ball receiving part 223 and the roulette plate 212 can be made short, the viewing angle γ (see FIG. 20) is wide enough for a game player to locate the ball 11 regardless of which ball receiving part 223 the ball 11 is received in, resulting in increased entertainment.

Also, since the central fixing part 222 is fixed and only the rotating part 222 is rotated, it is possible to reduce the load imposed on the drive motor 234. In addition, since the number of the fixed discharge holes 243 can be reduced to the minimum (a fixed discharge hole in case of the second embodiment), it is possible to simplify a construction of the roulette device 202.

The ball receiving part 223 and the bank passage 229 are continuously formed through an inclined plane 228 which is inclined at a predetermined angle in an ascending direction from the ball receiving part 223 to the bank passage 229. Accordingly, a game player can easily locate the ball 11 received in the ball receiving part 223, resulting in increased entertainment.

Also, the wall portion 231 is formed to be continuous to the bank passage 229 on its outer periphery. Accordingly, it is not apprehended that the ball 11 rotating on the bank passage 229 gets out of the roulette plate 212.

Also, since the depth L2 of the ball receiving part 223 is formed to be shorter than the diameter D of the ball 11, the ball 11 is not completely covered by the ball receiving part 223 and the ball received in the ball receiving part 223 can be easily found by game players when the ball 11 is received in the ball receiving part 223.

While the present invention has been described with reference to exemplary embodiments thereof, it will be understood by those skilled in the art that various changes in form and details may be made therein without departing from the scope of the present invention.

For example, although the ball 11 rolling toward the bank passage by air pressure applied from the first discharge hole 35 or the fixed discharge hole 243 rotates along a circumferential orbit on the bank passage 29, 229 by air pressure applied from the second discharge hole 36 in the first and second embodiments, the rim 21, 221 may be rotated instead of providing the second discharge hole 36. When the rim 21, 221 is rotated, the ball 11 located on the rim is also rotated along a circumferential direction, whereby the ball 11 rolls along the bank passage 29, 229 by the centrifugal force.

In addition, although the air pressure of the compressed air is applied to the ball in the roulette plate in the first and second embodiments, the ball 11 may roll with magnetic forces by providing a permanent magnet in the ball 11 and providing an electromagnet on the first discharge hole 35, the fixed discharge hole 243, and the second discharge hole 36.

Also, although the air is discharged from all the ball receiving part 23 via the air pipe 38 in the first embodiment, the air may be discharged from only the first discharge hole 35 located corresponding to a ball receiving part 23 receiving the ball 11 by determining which ball receiving part 23 is receiving the ball 11 by use of the light-emitting unit 32 and the light-receiving unit 33.

Further, although the air passing hole 235 passing the air from the fixed discharge hole 243 is formed in a circular-shaped hole in the second embodiment, the air passing hole 235 may be formed in a slot-shaped hole formed in a vertical or horizontal direction if only the air discharged from the fixed discharge hole 243 can pass through the ball receiving part 223.

According to the first embodiment, in the roulette device, the first discharge holes, through which the air compressed by the compressor is discharged toward the bank passage, are respectively provided in the ball receiving parts for receiving the ball rolling on the roulette plate having a plurality of marks arranged thereon, it is possible to roll the ball received in the ball receiving part toward the bank passage by air pressure of the air discharged from the first discharge hole, thereby rolling the ball repeatedly on the roulette plate without the need to take back the ball from the roulette plate. Accordingly, there is no need to prepare a complex apparatus such as a unit for collecting the ball or a unit for discharging the ball, thus facilitating operation and maintenance of the device and reducing the operation and maintenance costs.

Also, since the ball receiving parts and the bank passage are continuously formed via an inclined plane which is inclined in an ascending direction from the ball receiving parts to the bank passage at a predetermined angle, a game player can easily locate the ball received in the ball receiving part, resulting in increased entertainment.

Further, since the ball receiving part is formed to have a depth shorter than the diameter of the ball in respect to the inclined plane, the ball is not completely covered by the ball receiving part when the ball is received in the ball receiving part. Further, since the depths of the ball receiving part and the roulette plate can be made short, the game player can easily locate the ball received in the ball receiving part, resulting in increased entertainment.

Furthermore, in the roulette device, since the bank passage has a wall portion which is provided on an outer periphery to be continuous to the bank passage, the ball rolling on the bank passage will not get out of the roulette plate due to the centrifugal force, whereby a game player can play the game safely.

Since the roulette device further includes the second discharge hole which discharges the air compressed by the compressor to a circumferential direction of the bank passage, it is possible to roll the ball received in the ball receiving part toward the bank passage by air pressure of the air discharged from the first discharge hole and, at the same time, to roll the ball along a circumferential orbit on the bank passage by air pressure of the air discharged from the second discharge hole, thereby rolling the ball repeatedly on the roulette plate along the bank passage without the need to take back the ball from the roulette plate. Accordingly, there is no need to prepare a complex apparatus such as a unit for collecting the ball or a unit for discharging the ball, thus facilitating operation and maintenance of the device and reducing the operation and maintenance costs. In addition, since the depths of the ball receiving part and the roulette plate can be made short, the game player can easily locate the ball received in the ball receiving part, resulting in increased entertainment.

Also, according to the first embodiment, there is provided a game control method of allowing the ball to roll on the roulette plate and of allowing the ball to be received in a ball receiving part after an elapse of a predetermined time. The method includes a step of compressing air by the compressor; a first air discharging step of discharging the air compressed by the compressor from the first discharge hole provided in the ball receiving part for a predetermined time so that the ball received in the ball receiving part is sent through the inclined plane toward the bank passage; a second air discharging step of discharging the air compressed by the compressor from the second discharge holes provided in the bank passage so that the ball sent by the first air discharging step rolls along the bank passage; and a step of stopping the discharge of the air from the second discharge holes by the second air discharging step after an elapse of a predetermined time, so that the ball rolling along the bank passage rolls down the inclined plane and is then received in the ball receiving part. Therefore, it is possible to repeatedly roll the ball on the roulette plate by air pressure of the air compressed by the compressor without the need to take back the ball from the roulette plate. Accordingly, there is no need to prepare a complex apparatus such as a unit for collecting the ball or a unit for discharging the ball, thus facilitating operation and maintenance of the device and reducing the operation and maintenance costs. In addition, since the depths of the ball receiving part and the roulette plate can be made short, the game player can easily locate the ball received in the ball receiving part, resulting in increased entertainment.

Further, according to the second embodiment, a roulette device includes: the fixed discharge hole which is provided on the central fixing part and discharges the air compressed by the compressor to the ball received in the ball receiving part; and the bank discharge hole which discharges the ball to a circumferential direction of the bank passage, the ball receiving part being rotated to correspond to the location of the fixed discharge hole. Therefore, it is possible to roll the ball received in the ball receiving part toward the bank passage by air pressure of the air discharged from the fixed discharge hole and to roll the ball along a circumferential orbit on the bank passage by air pressure of the air discharged from the bank discharge hole, thereby rolling the ball repeatedly on the roulette plate along the bank passage without the need to take back the ball from the roulette plate. Accordingly, there is no need to prepare a complex apparatus such as a unit for collecting the ball or a unit for discharging the ball, thus facilitating operation and maintenance of the device and reducing the operation and maintenance costs. In addition, since the depths of the ball receiving part and the roulette plate can be made short, the game player can easily locate the ball received in the ball receiving part, resulting in increased entertainment.

Also, since the ball receiving parts and the bank passage are continuously formed via an inclined plane which is inclined in an ascending direction from the ball receiving parts to the bank passage at a predetermined angle, a game player can easily locate the ball received in the ball receiving part, resulting in increased entertainment.

Also, since the ball receiving part is formed to have a depth shorter than the diameter of the ball in respect to the inclined plane, the ball is not completely covered by the ball receiving part when the ball is received in the ball receiving part. Further, since the depths of the ball receiving part and the roulette plate can be made short, the game player can easily locate the ball received in the ball receiving part, resulting in increased entertainment.

Also, since only the rotating part is rotated, it is possible to reduce the load imposed on the drive motor. In addition, since the number of the fixed discharge holes can be reduced to the minimum (e.g., a fixed discharge hole), it is possible to simplify a construction of the roulette device.

Also, in the roulette device according to the second embodiment, since the bank passage has a wall portion which is provided on an outer periphery to be continuous to the bank passage, the ball rolling on the bank passage will not get out of the roulette plate due to the centrifugal force, whereby a game player can play the game safely.

Further, in the above-mentioned structure, since the roulette device includes the bank discharge hole which discharges the air compressed by the compressor to a circumferential direction of the bank passage, it is possible to roll the ball received in the ball receiving part toward the bank passage by air pressure of the air discharged from the fixed discharge hole and to roll the ball along a circumferential orbit on the bank passage by air pressure of the air discharged from the second discharge hole, thereby rolling the ball repeatedly on the roulette plate along the bank passage without the need to take back the ball from the roulette plate. Accordingly, there is no need to prepare a complex apparatus such as a unit for collecting the ball or a unit for discharging the ball, thus facilitating operation and maintenance of the device and reducing the operation and maintenance costs. In addition, since the depths of the ball receiving part and the roulette plate can be made short, the game player can easily locate the ball received in the ball receiving part, resulting in increased entertainment.

Furthermore, according to the second embodiment, there is provided a game control method of allowing the ball to roll on the roulette plate and receiving the ball in a ball receiving part after an elapse of a predetermined time. The method includes a step of detecting the specific ball receiving part having the ball received therein; a step of rotating the rotating part at a predetermined angle in a predetermined direction with respect to the central fixing part so that the air is discharged from the fixed discharge hole through the specific ball receiving part; a step of compressing air by the compressor; a first air discharging step of discharging the air compressed by the compressor from the fixed discharge hole through the specific ball receiving part for a predetermined time so that the ball received in the specific ball receiving part is sent through the inclined plane toward the bank passage; a second air discharging step of discharging the air compressed by the compressor from the bank discharge hole so that the ball sent by the first air discharging step rolls along the bank passage; and a step of stopping the discharge of the air from the bank discharge holes by the second air discharging step after an elapse of a predetermined time, so that the ball rolling along the bank passage rolls down the inclined plane and is then received in the ball receiving part. Therefore, it is possible to repeatedly roll the ball on the roulette plate by air pressure of the air compressed by the compressor without the need to take back the ball from the roulette plate. Accordingly, there is no need to prepare a complex apparatus such as a unit for collecting the ball or a unit for discharging the ball, thus facilitating operation and maintenance of the device and reducing the operation and maintenance costs. In addition, since the depths of the ball receiving part and the roulette plate can be made short, the game player can easily locate the ball received in the ball receiving part, resulting in increased entertainment.

Also, since only the rotating part is rotated, it is possible to reduce the load imposed on the drive motor. In addition, since the number of fixed discharge holes can be reduced to the minimum (e.g., a fixed discharge hole), it is possible to simplify a construction of the roulette device.

What is claimed is:

1. A roulette device comprising:

a roulette plate having a plurality of marks arranged thereon;

a ball which rolls on the roulette plate;

a plurality of ball receiving parts which are formed corresponding to the marks in a circumferential direction of the roulette plate to receive the ball;

a bank passage which is provided on an outer periphery of the ball receiving parts of the roulette plate and on which the ball rolls along a circumferential orbit;

a compressor which compresses air; and a first discharge hole which is provided in each ball receiving part and through which the air compressed by the compressor is discharged to the bank passage.

2. The roulette device according to claim 1, further comprising:

a second discharge hole which is provided in the bank passage and through which the air compressed by the compressor is discharged to a circumferential direction of the bank passage.

3. The roulette device according to claim 1, wherein the ball receiving parts and the bank passage are continuously formed via an inclined plane which is inclined in an ascending direction from the ball receiving parts to the bank passage at a predetermined angle.

4. The roulette device according to claim 3, wherein the ball receiving part is formed to have a depth smaller than the diameter of the ball with respect to the inclined plane.

5. The roulette device according to claim 1, wherein the bank passage has a wall portion which is provided on an outer periphery to be continuous to the bank passage.

6. A roulette device comprising:

a roulette plate having a plurality of marks arranged thereon;

a ball which rolls on the roulette plate;

a plurality of ball receiving parts which are formed corresponding to the marks in a circumferential direction of the roulette plate to receive the ball;

a bank passage which is provided on an outer periphery of the ball receiving parts of the roulette plate and on which the ball rolls along a circumferential orbit;

a central fixing part;

a rotating part which is provided in a vicinity of the central fixing part and has the marks and the ball receiving parts thereon;

a supporting member which rotatably supports the rotating part with respect to the central fixing part;

a drive unit which rotates the rotating part in a predetermined direction with respect to the central fixing part;

a compressor which compresses air;

a fixed discharge hole which is provided in the central fixing part and through which the air compressed by the compressor is discharged to the ball received in the ball receiving part;

a ball detecting unit which detects a specific ball receiving part having the ball therein, when the ball is received in the specific ball receiving part among the plurality of ball receiving parts; and a drive control unit which controls the drive unit so that the specific ball receiving part detected by the ball detecting unit is located at a predetermined position where the air is discharged from the fixed discharge hole, wherein the roulette plate includes: the central fixing part; the rotating part; and the supporting member.

7. The roulette device according to claim 6, further comprising:

a bank discharge hole which is provided in the bank passage and through which the air compressed by the compressor is discharged to a circumferential direction of the bank passage.

8. The roulette device according to claim 6, wherein the ball receiving parts and the bank passage are continuously formed via an inclined plane which is inclined in an ascending direction from the ball receiving parts to the bank passage at a predetermined angle.

9. The roulette device according to claim 8, wherein the ball receiving part is formed to have a depth smaller than the diameter of the ball with respect to the inclined plane.

10. The roulette device according to claim 6, wherein the bank passage has a wall portion which is provided on an outer periphery to be continuous to the bank passage.

* * * * *